US007280022B2

(12) United States Patent
Shinmen et al.

(10) Patent No.: US 7,280,022 B2
(45) Date of Patent: Oct. 9, 2007

(54) INVERTER TRANSFORMER

(75) Inventors: Hiroshi Shinmen, Fukuroi (JP); Masashi Norizuki, Fukuroi (JP)

(73) Assignee: Minebea Co., Ltd., Kitasaku (JP)

( * ) Notice: Subject to any disclaimer, the term of this patent is extended or adjusted under 35 U.S.C. 154(b) by 153 days.

(21) Appl. No.: 10/560,168

(22) PCT Filed: Jun. 3, 2004

(86) PCT No.: PCT/JP2004/007715

§ 371 (c)(1),
(2), (4) Date: May 9, 2006

(87) PCT Pub. No.: WO2004/109723

PCT Pub. Date: Dec. 16, 2004

(65) Prior Publication Data

US 2006/0279392 A1 Dec. 14, 2006

(30) Foreign Application Priority Data

Jun. 9, 2003 (JP) ..... 2003-164175

(51) Int. Cl.
*H01F 27/02* (2006.01)

(52) U.S. Cl. ..... 336/83

(58) Field of Classification Search ..... 336/83, 336/170, 180–184, 198, 200, 212, 214, 215, 336/221; 323/250–251; 363/253
See application file for complete search history.

(56) References Cited

U.S. PATENT DOCUMENTS

| | | | | |
|---|---|---|---|---|
| 5,847,518 | A | 12/1998 | Ishiwaki | |
| 6,424,247 | B2 * | 7/2002 | Suzuki | 336/110 |
| 6,714,111 | B2 * | 3/2004 | Suzuki | 336/110 |
| 6,894,596 | B2 * | 5/2005 | Suzuki | 336/83 |
| 7,015,785 | B2 * | 3/2006 | Wu et al. | 336/212 |
| 7,183,889 | B2 * | 2/2007 | Fushimi | 336/208 |
| 2001/0024379 | A1 | 9/2001 | Suzuki | |
| 2002/0176268 | A1 | 11/2002 | Suzuki | |

FOREIGN PATENT DOCUMENTS

| | | | |
|---|---|---|---|
| DE | 197 28 667 | A1 | 1/1998 |
| EP | 1 137 017 | A2 | 9/2001 |
| EP | 1 265 460 | A2 | 12/2002 |
| JP | 64-037816 | A | 2/1989 |
| JP | 07-014623 | U | 3/1995 |
| JP | 09-162047 | A | 6/1997 |
| JP | 10-241957 | A | 9/1998 |
| JP | 2001-267156 | A | 9/2001 |
| JP | 2002-164235 | A | 6/2002 |
| JP | 2002-353044 | A | 12/2002 |

* cited by examiner

*Primary Examiner*—Tuyen T. Nguyen
(74) *Attorney, Agent, or Firm*—Oliff & Berridge PLC

(57) ABSTRACT

An inverter transformer in which to overall structure and manufacturing process can be simplified despite its closed magnetic path structure, and a cost increase can be suppressed. Primary windings (24*a*, 24*b*, 24*c*) and secondary windings (25*a*, 25*b*, 25*c*) wound around a plurality of rod-like cores (23*a*, 23*b*, 23*c*) have leakage inductances. The primary windings (24*a*, 24*b*, 24*c*) axe wound around respective rod-like cores (23*a*, 23*b*, 23*c*) such that magnetic fluxes being induced in respective cores by the currents flowing through the primary windings (24*a*, 24*b*, 24*c*) are directed reversely to magnetic fluxes being induced in adjacent cores.

11 Claims, 21 Drawing Sheets

INVERTER TRANSFORMER

BACKGROUND OF THE INVENTION

1. Field of the Invention

The present invention relates to an inverter transformer for use in an inverter circuit to light a discharge lamp, such as a cold cathode fluorescent lamp, as a light source of a lighting device for a liquid crystal display.

2. Description of the Related Art

Currently, a liquid crystal display (LCD) is increasingly used as a display unit for a personal computer, and the like. The LCD lacks a light emitting function, and therefore requires a lighting device, such as a back-light system or a front-light system, and a cold cathode fluorescent lamp (CCFL) is generally used as a light source for such a lighting device. In case of discharging and lighting a CCFL having a length, for example, about 500 mm, an inverter circuit is used which is adapted to generate a high-frequency voltage of 60 kHz, about 1600 V at the time of starting discharge. The inverter circuit controls a voltage applied to the CCFL such that after the CCFL is discharged, the voltage is lowered to about 1200 V which is a voltage required for keeping the discharge. Some inverter circuits include a closed magnetic path type inverter transformer and also a ballast capacitor, and the ballast capacitor additionally required prohibits reduction in dimension and cost. Further, even after discharging a CCFL, the voltage at the time of starting discharge must be maintained, which is disadvantageous in view of safety.

Recently, an open magnetic path type inverter transformer is employed which leverages the function of a leakage inductance serving as a ballast capacitance in place of a ballast capacitor. Some of such open magnetic path type inverter transformers may use a bar-shaped magnetic core (I-core), and others may use a combination of a bar-shaped magnetic core and a rectangular frame-shaped magnetic core (refer to Japanese Patent Application Laid-Open No. 2002-353044).

FIG. 19 is an equivalent circuit of an inverter transformer having a leakage inductance as described above. Referring to FIG. 19, the inverter transformer includes an ideal transformer 1 having no loss with a winding ratio of 1:n, leakage inductances L1 and L2, and a mutual inductance Ls, and CCFLs 2. In the inverter transformer, the leakage inductances L1 and L2 function as a ballast inductance, and the CCFLs 2 can be lighted normally without using a ballast capacitor.

FIG. 20 is a schematic view of a traditional inverter transformer 1A of open magnetic path type. The inverter transformer 1A includes a bar-shaped magnetic core (I-core) 3 indicated by a dashed line, a bobbin 4 defining a hollow 5 to house the bar-shaped magnetic core 3, a primary winding 6 wound around the bobbin 4, a secondary winding 7 wound around the bobbin 4, a terminal block 9 provided with terminal pins 8 for the primary winding 6, and a terminal block 11 provided with terminal pins 10 for the secondary winding 7. Since a high voltage is induced at the secondary side, the secondary winding 7 is divided by partitions 12 formed at the bobbin 4 in order to prevent surface discharge. The inverter transformer 1A in FIG. 20, which employs a bar-shaped magnetic core as described above, is simple in structure compared with an inverter transformer (not shown) which employs a magnetic core having a closed configuration, such as a rectangular core. However, magnetic flux leaks from the bar-shaped magnetic core, especially from the ends thereof FIG. 21 is an exploded perspective view of another traditional inverter transformer 1B. The inverter transformer 1B includes a bar-shaped magnetic core 3, a rectangular frame-shaped magnetic core 13, a bobbin 14 having a hollow to house the bar-shaped core 3, and primary and secondary windings 6 and 7 wound around the bobbin 14. The end portions of the bar-shaped magnetic core 3 are engaged with respective recesses 15 of the rectangular frame-shaped magnetic core 13 such that gap sheets formed of a non-magnetic material are put between the bar-shaped magnetic core 3 and the rectangular frame-shaped magnetic core 13 so as to form gaps therebetween, thereby generating a prescribed amount of leakage inductance. In the inverter transformer 1B thus structured, magnetic flux leaking from the bar-shaped core 3 passes through the rectangular frame-shaped magnetic core 13, and leakage flux is small compared with an inverter transformer employing only a bar-shaped magnetic core (without a rectangular frame-shaped magnetic core).

In an inverter transformer involving leakage inductance, leakage flux may possibly influence neighboring components or wires, or emit noises, and the components and wires must be appropriately located in order to keep away from the leakage flux thus placing restrictions on arrangement of components and wires. This may result in increase of product dimension or deterioration of characteristics. Also, if a magnetic material is placed at the path of the leakage flux, the flux path may be influenced when the leakage flux passes through the magnetic material, which causes the leakage inductance to vary or fluctuate disturbing stability, further causing the inverter transformer to undergo variation in characteristic and consequently to undergo change in operation.

Thus, an inverter transformer including only a bar-shaped magnetic core is simple in structure but suffers increase in leakage flux distribution range, and also has difficulty in adjusting the amount of leakage inductance. On the other hand, an inverter transformer including a rectangular frame-shaped magnetic core together with a bar-shaped magnetic core has a smaller leakage flux distribution range than the inverter transformer including a bar-shaped magnetic core only, but incurs increase in number of components, and a molding or machining process is required for producing the rectangular frame-shaped magnetic core. Also, when engaging the bar-shaped magnetic core with the rectangular frame-shaped magnetic core, a complex and troublesome process of putting gap sheets therebetween is required for adjusting leakage inductance.

An inverter transformer incorporating only a bar-shaped magnetic core generates a wide distribution range of leakage flux as described above. Such an inverter transformer is magnetically shielded in order to prevent the inverter transformer from affecting neighboring components, and also to prevent the neighboring components from affecting the inverter transformer. This solution by magnetically shielding a product, however, requires a shielding case, and this leads to increase in product dimension and product cost. Also, processes of fixing the inverter transformer to the shielding case and taking out lead wires from the shielding case are additionally required, thus making cost reduction further difficult. And, a defective fixing of the inverter transformer to the shielding case may raise deterioration in reliability. On the other hand, an inverter transformer employing a rectangular frame-shaped magnetic core together with a rectangular frame-shaped magnetic core, while generating a reduced amount of leakage flux, has a complicated structure and requires additional troublesome manufacturing processes thus pushing up production cost.

SUMMARY OF THE INVENTION

The present invention has been made in the light of the above problems, and it is an object of the present invention to provide an inverter transformer which has an open magnetic path structure but is simple in structure, and which has its production process simplified compared with a traditional open magnetic path structure including a rectangular frame-shaped magnetic core, thus preventing cost increase.

In order to achieve the object described above, according to an aspect of the present invention, there is provided an inverter transformer which is used in an inverter circuit to invert DC into AC, transforms a voltage inputted at a primary side and outputs the transformed voltage at a secondary side, and which includes a plurality of winding units, each of the winding units including: a bar-shaped magnetic core; and a primary winding and a secondary winding which are wound around the bar-shaped magnetic core, and which have respective leakage inductances. In the inverter transformer described above, the primary windings are wound around respective bar-shaped magnetic cores in such a manner that a magnetic flux generated in one magnetic core by a current flowing through a primary winding provided around the one magnetic core is directed opposite to a magnetic flux generated in another magnetic core adjacent to the one magnetic core by a current flowing through a primary winding provided around the adjacent magnetic core.

In the aspect of the present invention, at least one portion of each winding unit may be covered with respect to the longitudinal direction by a magnetic resin formed of a resin containing a magnetic substance.

In the aspect of the present invention, the magnetic resin may cover the entire portion of each winding unit In the aspect of the present invention, the magnetic resin may cover both end portions of each winding unit and/or a portion of each winding unit located at a boundary area between the primary and secondary windings.

In the aspect of the present invention, an external unit having a larger saturation magnetic flux density than the magnetic resin may be disposed so as to cover at least one portion of the circumference of a transformer body which includes the plurality of winding units and the magnetic resin.

In the aspect of the present invention, the external unit may have a smaller magnetic resistance than the magnetic resin.

In the aspect of the present invention, the external unit may have either a squared C configuration or a substantially circular configuration in cross section so as to cover the circumference of the transformer body.

In the aspect of the present invention, the external unit may include a plurality of members, and the members may be combined into a box configuration so as to cover the transformer body.

In the aspect of the present invention, the external unit may be a sintered compact.

In the aspect of the present invention, the magnetic resin may have a smaller relative magnetic permeability than the magnetic cores.

In the aspect of the present invention, the magnetic substance contained in the resin may be Mn—Zn ferrite, Ni—Zn ferrite, or iron powder.

Since the primary windings are wound in such a manner that a magnetic flux generated in one magnetic core by a current flowing through a primary winding provided around the one magnetic core is directed opposite to a magnetic flux generated in another magnetic core adjacent to the one magnetic core by a current flowing through a primary winding provided around the adjacent magnetic core, leakage flux spreading around the inverter transformer is reduced, thus having smaller influences on the components and wires arranged around the inverter transformer. This structure also contributes to making it harder for the characteristics of the inverter transformer to suffer the effects of metals present around the inverter transformer, thus enabling the leakage inductance of the inverter transformer to be stabilized. On the other hand, since the secondary windings are wound in such a manner that voltages induced in the secondary windings have the same polarity, there is no voltage difference between the secondary windings W2 thus proving favorable in terms of withstand voltage and consequently improving safety, and as a result the number of components is reduced, the device can be downsized, and eventually the device can be produced inexpensively.

Also, since the magnetic cores are totally or partly covered by the magnetic resin, leakage flux spreading around the inverter transformer is reduced, thus having smaller influences on the components and wires arranged around the inverter transformer. This structure also keeps the characteristics of the inverter transformer from suffering the effects of metals present around the inverter transformer, thus enabling the leakage inductance of the inverter transformer to be stabilized.

Further, since the magnetic resin is disposed so as to perform magnetic shielding, a case for magnetic shielding is not required thus preventing cost increase. This eliminates a work process of fixing the inverter transformer to the case, or taking out lead wires from the case, and consequently the production process is simplified. And at the same time, since the inverter transformer is resin-molded, the inverter transformer has its mechanical strength increased thus enhancing the product reliability.

Still further, since the external unit, which has a larger saturation magnetic flux density than the magnetic resin, is disposed so as to cover at least one portion of the circumference of the inverter transformer body that comprises the plurality of winding units and the magnetic resin, most of magnetic fluxes leaking out from the magnetic cores so as to pass through the magnetic resin and then to leak out further from the magnetic resin are adapted to pass through the external unit. Consequently, the amount of the leakage fluxes can be reduced effectively compared when the magnetic fluxes is prevented from leaking out by the magnetic resin only without providing the external unit, and therefore the thickness of the magnetic resin can be reduced, which results in reduction of the entire cross section area of the inverter transformer thus downsizing the inverter transformer.

And, the number of turns and the leakage inductance on the winding can be adjusted to the optimum conditions of the circuit operation by adjusting the magnetic characteristics such as relative magnetic permeability of the magnetic resin and adjusting the coverage area and thickness of the magnetic resin. Consequently, the inductance value can be adjusted without changing the number of turns on the primary and secondary windings and the configuration and characteristics of the magnetic core, thus providing applicability to various inverter transformers.

DETAILED DESCRIPTION OF THE PREFERRED EMBODIMENTS

Figure 1:
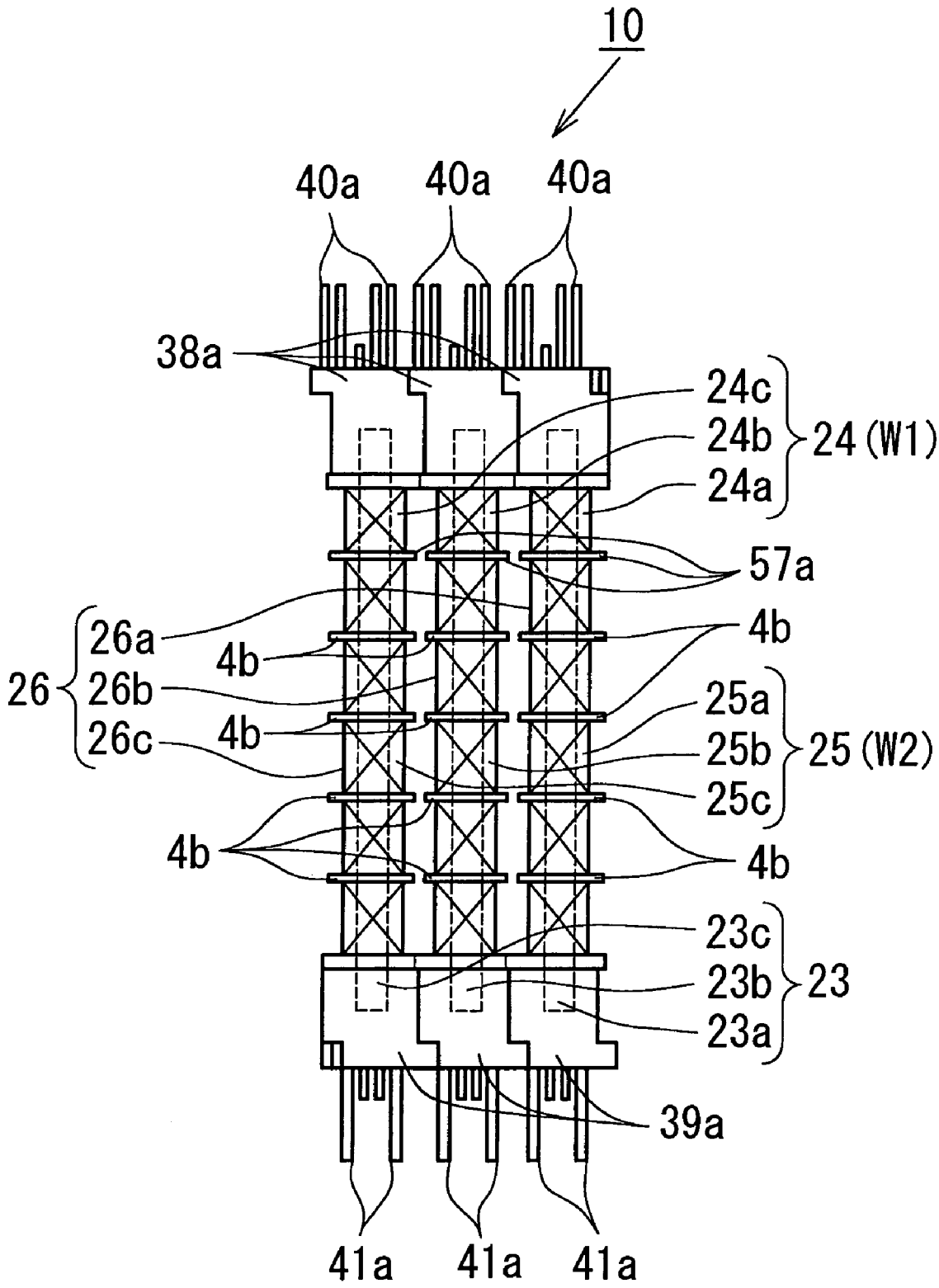
FIG. 1 is a schematic top plan view of an inverter transformer according to a first embodiment of the present invention.

Preferred embodiments of the present invention will hereinafter be described with the accompanying drawings.

A first embodiment of the present invention will be described with FIG. 1. An inverter transformer 10 according to the first embodiment is for lighting three CCFLs concurrently. The number of CCFLs to be lighted is not limited to three but may alternatively be other than three, as long as primary windings are wound around respective bar-shaped magnetic ores in such a manner that a magnetic flux generated in one magnetic core by a current flowing through a primary winding provided around the one magnetic core is directed opposite to a magnetic flux generated in another magnetic core adjacent to the one magnetic core by a current flowing through a primary winding provided around the adjacent magnetic core as described later. In such a case, the magnetic cores are provided in a number equal to the number of the CCFLs. In the following description, for the purpose of simplification as appropriate, primary windings 24 (24*a*, 24*b* and 24*c*) are reference-marked as W1, secondary windings 25 (25*a*, 25*b* and 25*c*) are reference-marked as W2, rectangular tubular bobbins 26 (26*a*, 26*b* and 26*c*) are referred to simply as bobbins 26, and bar-shaped magnetic cores 23 (23*a*, 23*b* and 23*c*) are referred to simply as cores 23.

The inverter transformer 10 shown in FIG. 1 is for lighting three CCFLs as mentioned above. Three bobbins 26 are shaped identical with one another. Three cores 23 are inserted through respective bobbins 26, which are engagingly fitted to each other. The cores 23 are formed of a soft magnetic material, for example, Mn—Zn ferrite, and have a relative magnetic permeability of, for example, 2000. The inverter transformer 10 generally includes the three cores 23, the three bobbins 26 having respective primary windings W1 and secondary windings W2 wound therearound, primary winding terminal blocks 38*a* each engagingly attached to one end of each bobbin 26, and secondary winding terminal blocks 39*a* each engagingly attached to the other end of each bobbin 26. The primary and secondary winding terminal blocks 38*a* and 39*a* are formed of an insulating material and are disposed apart from each other so as to sandwich the bobbins 26. Terminal pins 40*a* are fixedly attached to the primary winding terminal blocks 38*a*, and terminal pins 41*a* are fixedly attached to the secondary winding terminal blocks 39*a*.

The primary winding terminal blocks 38*a* are each provided with a hole or groove (not shown) for accommodating lead wires (not shown) of the primary winding W1, which are connected to the primary winding terminal pins 40*a*. The secondary winding terminal blocks 39*a* are each provided with a hole or groove (not shown) for accommodating lead wires (not shown) of the secondary winding W2, which are connected to the secondary winding terminal pins 41*a*. Those lead wires, each coated with an insulating material, are inserted through the hole or put in the groove so as to secure sufficient surface distance and insulation.

The bobbins 26 are each provided with a partition 57*a* which separates the primary winding W1 and the secondary winding W2. Specifically, the primary winding W1 is wound around the bobbin 26 between the primary winding terminal block 38*a* and the partition 57*a*, and the secondary winding W2 is wound around the bobbin 26 between the secondary winding terminal block 39*a* and the partition 57*a*. Since a high voltage is generated at the secondary winding W2, the secondary winding W2 is split into several sections by means of insulating partitions 4*b* so that a sufficient surface distance is secured to prevent creeping discharge. The insulating partitions 4*b* are each provided with a notch for connecting adjacent sections of the secondary winding W2.

The operation of the inverter transformer 10 described above will hereinafter be explained. Magnetic flux generated in the core 23 leaks out from the core 23 so as to provide leakage inductance. That is to say, the magnetic path formed by the core 23 is not a closed magnetic path, and the inverter transformer 10 virtually has an open magnetic path structure having a leakage inductance. Accordingly, there is generated not only a magnetic flux that passes entirely through the core 23 so as to interlink the primary winding W1 and the secondary winding W2, but also a leakage flux that interlinks either with the primary winding W1 only or with the secondary winding W2 only thus failing to contribute to providing electromagnetic coupling between the primary winding W1 and the secondary winding W2, whereby leakage inductance is generated. The leakage inductance acts as ballast inductance so as to duly discharge and light the CCFLs connected to the secondary windings W2.

The generated leakage flux, however, not only provides leakage inductance but also have an adverse effect on devices arranged near the inverter transformer 10, and therefore should be prevented from spreading out from the inverter transformer 10. In the present invention, the primary windings W1 are arranged around respective cores 23 such that magnetic fluxes generated by currents flowing through the primary windings W1 are directed opposite to each other in any adjacent cores 23, thereby preventing the leakage flux from spreading out from the inverter transformer 10.

Figure 2:
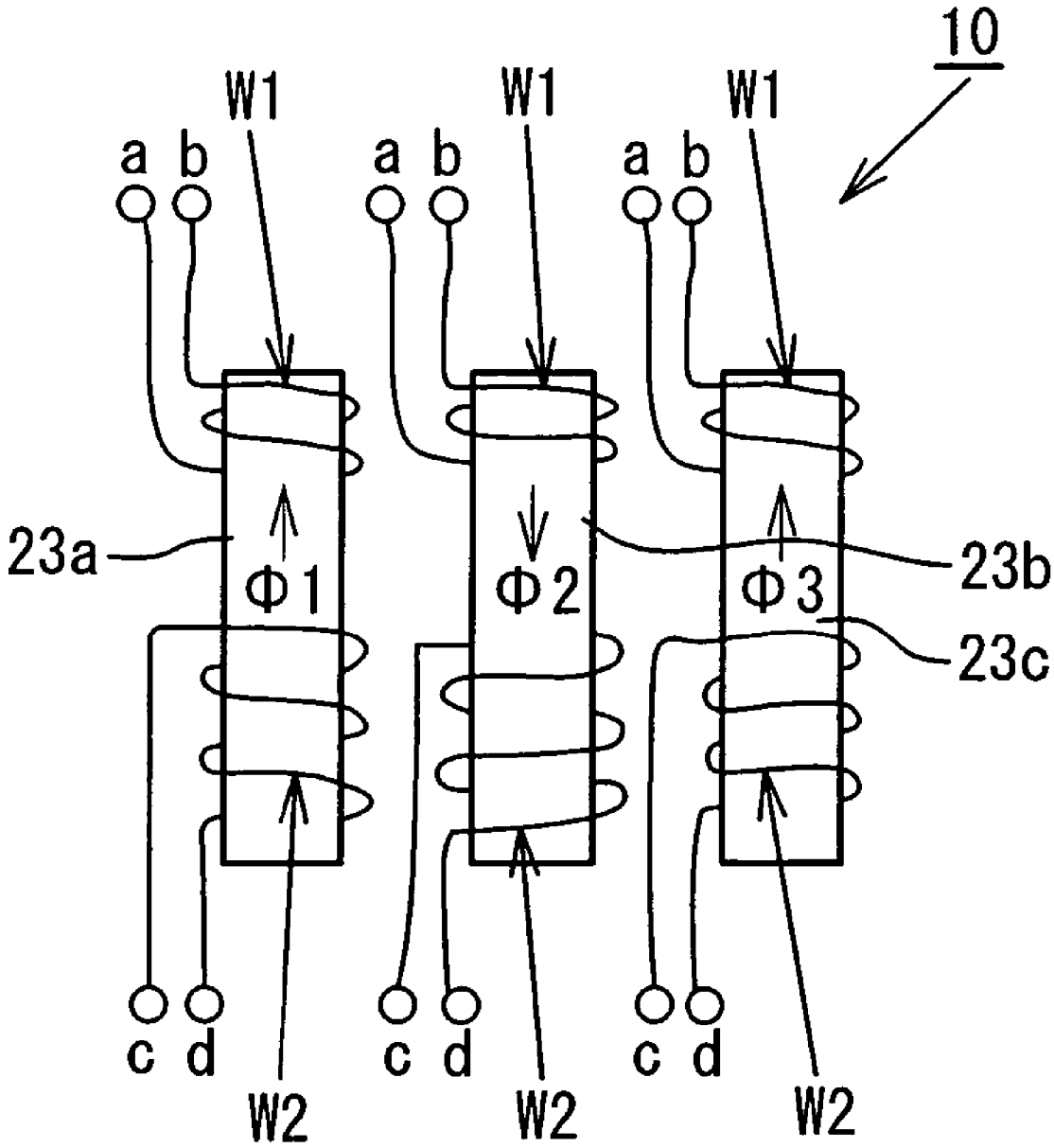
FIG. 2 is an explanatory view of states of windings and directions of magnetic fluxes generated by respective windings in an inverter transformer according to the present invention.

The operation of the primary windings W1 of the inverter transformer 10 arranged as described above will be described with reference to FIG. 2. Magnetic fluxes Φ1 and Φ3, which are generated respectively in the cores 23*a* and 23*c* (first group core) by respective currents flowing through the primary windings W1 wound around two non-adjacent cores 23*a* and 23*c* of the three cores 23, are directed identical with each other. A magnetic flux Φ2, which is generated in the core 23*b* (second group core) disposed between the two first group cores, is directed opposite to the magnetic fluxes Φ1 and Φ3.

Figure 3A:
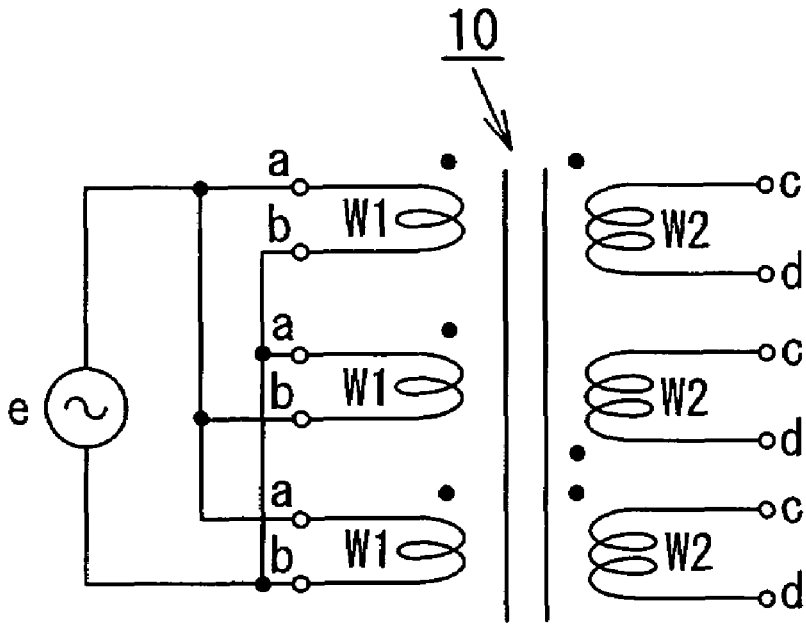
FIGS. 3(*a*) and 3(*b*) are explanatory views of winding methods for primary windings 1W in inverter transformers according to the present invention.
Figure 3B:
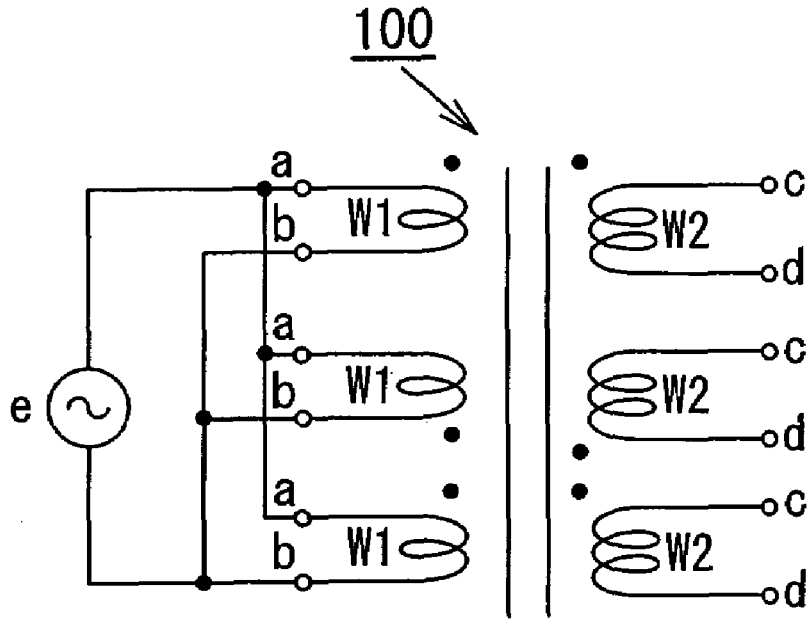

There are two kinds of methods as shown in FIGS. 3(*a*) and 3(*b*), in which the primary windings W1 are arranged so as to generate the magnetic fluxes Φ1, Φ2 and Φ3 as described above. Shown in FIG. 3(*a*) is one method, in which all of the primary windings W1 around the first and second group cores are wound in the same direction, and the polarity of a voltage e applied to the primary windings W1 around the first group cores is opposite to the polarity of a voltage e applied to the primary winding W1 around the second group core. Shown in FIG. 3(*b*) is the other method, in which the primary windings W1 around the first group cores are wound in the opposite direction to the primary winding W1 around the second group core, and the electrodes of a voltage e applied to all the primary windings W1 around the first and second group cores have the same polarity. In whichever methods, the magnetic fluxes Φ1 and Φ3 generated in the cores 23*a* and 23*c* (first group cores) are directed opposite to the magnetic flux Φ2 generated in the core 23*b* (second group core) disposed adjacent to the cores 23*a* and 23*c* (first group cores)

When all of the magnetic fluxes Φ, Φ1 and Φ2 are directed identical with one another, magnetic fluxes leaking out from the ends of the cores 23 repel one another, and most of them do not go through adjacent cores and spread out in the air around thus increasing leakage flux. On the other hand, in the inverter transformer 10 according to the first embodiment, the magnetic fluxes Φ1 and Φ3 generated in the first group cores 23*a* and 23*c* are directed opposite to the magnetic flux Φ2 generated in the second group core 23*b* disposed between the first group cores 23*a* and 23*c* as described above, and therefore magnetic fluxes leaking out from the ends of two adjacent cores, specifically, the cores 23*a* and 23*b*, and the cores 23*b* and 23*c*, do not repel each other, which causes an increased portion of the magnetic flux to go through adjacent cores. This reduces the amount of leakage flux that spreads out in the air around the inverter transformer. Consequently, influences on components and wirings disposed around the inverter transformer are reduced. The inverter transformer according to the present embodiment includes three cores, but the present invention is not limited to this structure and the inverter transformer may include any other plural number of cores insofar as magnetic fluxes going through adjacent cores are directed opposite to each other as described above.

The secondary windings W2 are arranged such that the electrodes of voltages induced in the secondary windings W2 around the first and second group cores 23 have the same polarity. For example, referring to each of FIGS. 3(*a*) and 3(*b*), since the primary windings W1 are wound around the cores 23 such that the magnetic flux generated in the middle core is directed opposite to the magnetic fluxes generated in the adjacent cores, the secondary winding W2 around the middle core is wound in the opposite direction to the secondary windings W2 wound around the adjacent cores so that the electrodes of voltages induced in all the secondary windings W2 have the same polarity.

As mentioned above, a high-frequency voltage of about 1600 V are generated in the secondary windings of the inverter transformer 10 for lighting CCFLs, and a voltage of about 1200 V for keeping the CCFLs discharging. However, since the voltages induced in the secondary windings W2 have the same polarity as described above, there is no voltage difference between the secondary windings W2 thus proving favorable in terms of withstand voltage and consequently enhancing safety.

Figure 4:
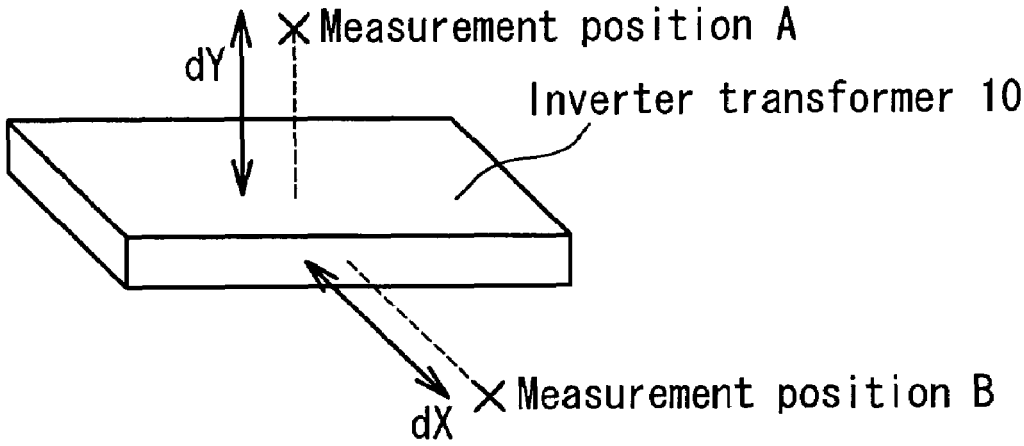
FIG. 4 is an explanatory view of positions A and B for measuring a magnetic field on an inventive sample according to the present invention and a comparative sample of a conventional product.
Figure 5:
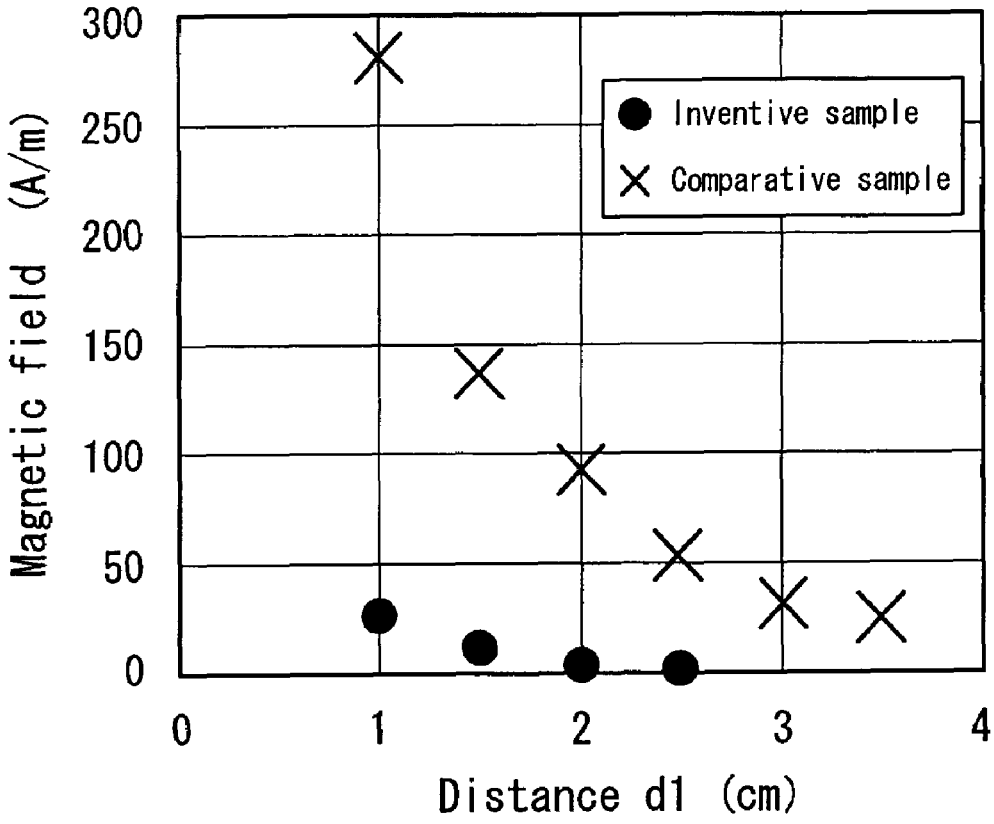
FIG. 5 is a graph showing measurement results at several positions A shown in FIG. 4 on the inventive and comparative samples.
Figure 6:
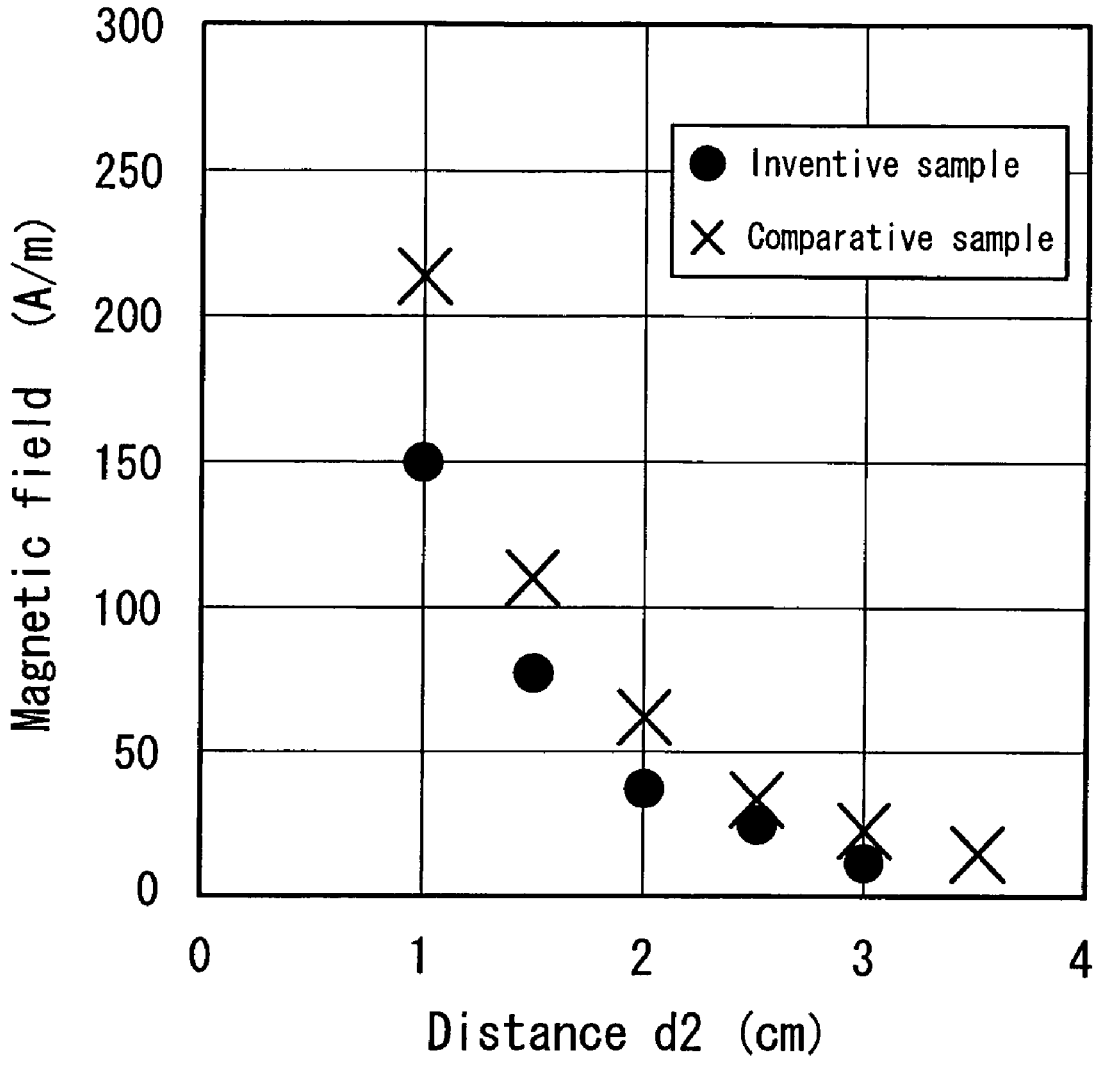
FIG. 6 is a graph showing measurement results at several positions B shown in FIG. 4 on the inventive and comparative samples.
Figure 7A:
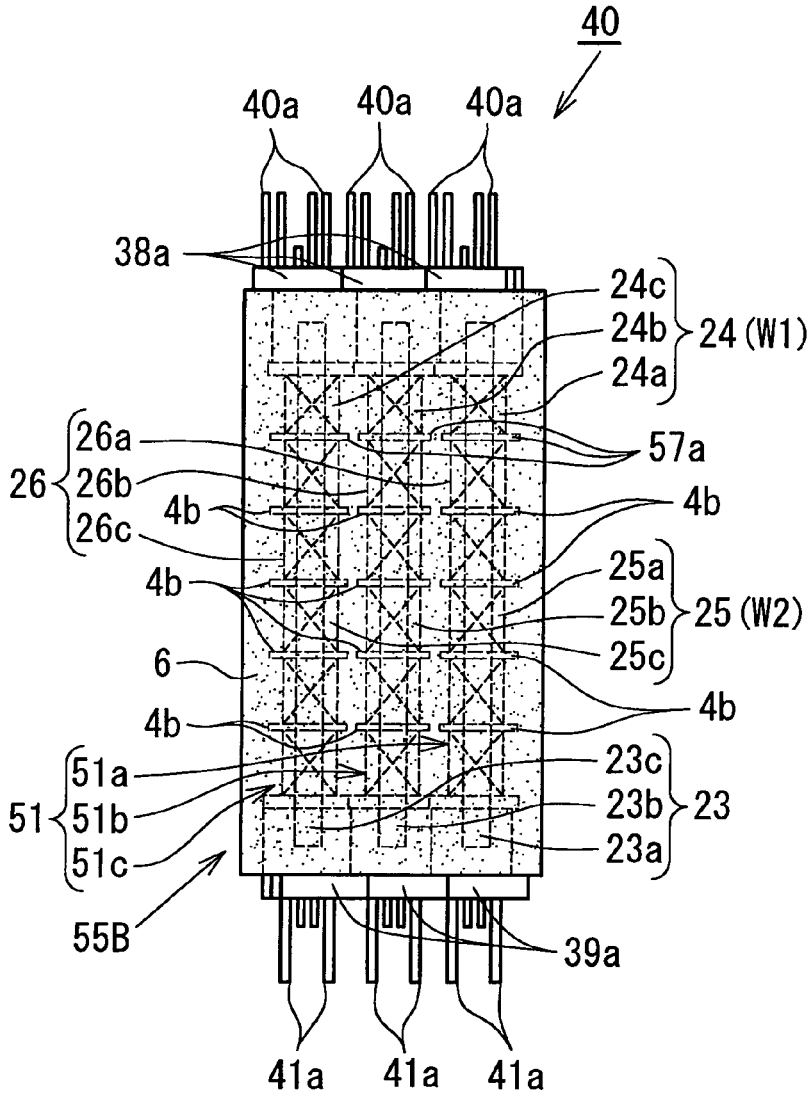
FIGS. 7(*a*), 7(*b*) and 7(*c*) are respectively schematic top plan, front elevation, and partial cross-sectional views of an inverter transformer according to a second embodiment of the present invention, and FIGS. 7(*d*) and 7(*e*) are respectively schematic front elevation and partial cross-sectional views of an inverter transformer according to a third embodiment of the present invention.
Figure 7B:
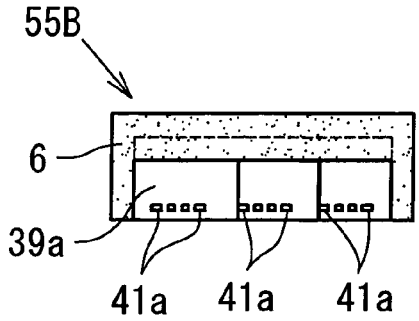
Figure 7D:
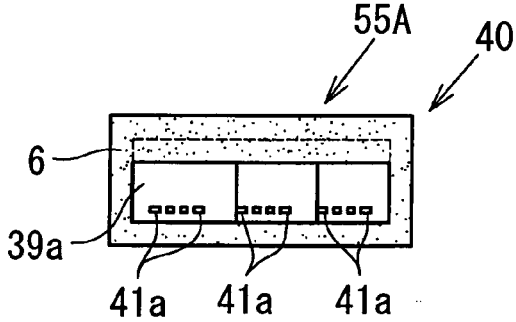
Figure 7C:
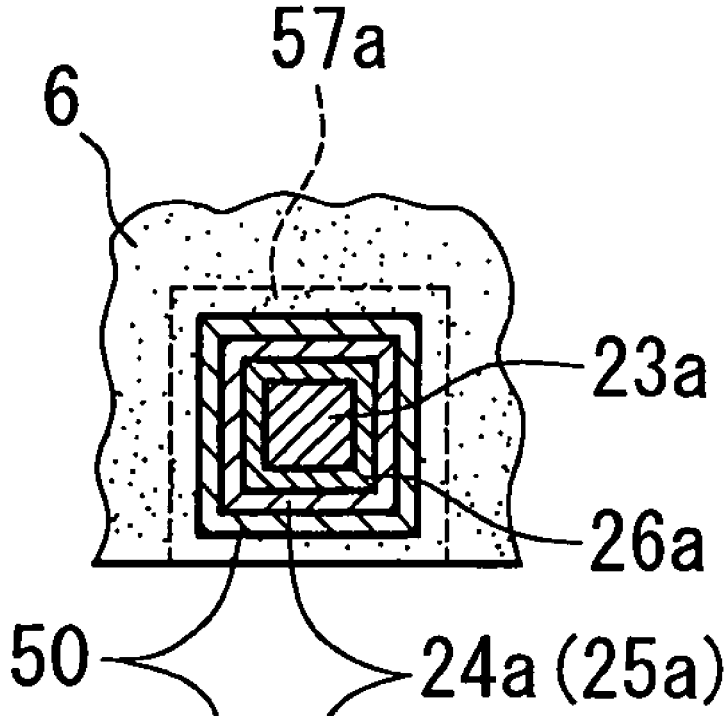
Figure 7E:
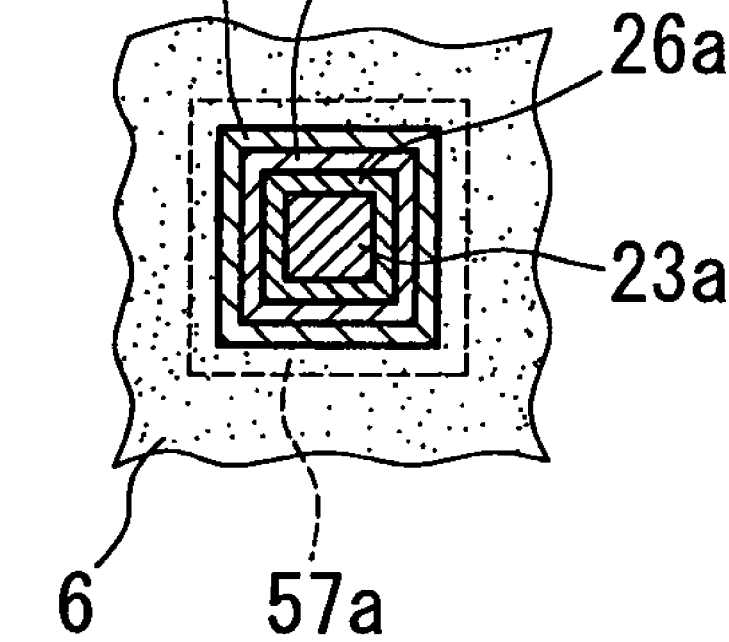

The characteristics of the inverter transformer 10 according to the first embodiment will be described with reference to FIGS. 4, 5 and 6. As for FIGS. 5 and 6, the primary windings W1 and the secondary windings W2 were arranged as shown in FIG. 3(*a*), specifically such that all the primary windings W1 were wound around the cores 23 in the same direction while the secondary winding W2 around the core 23*b* was wound in the opposite direction to the secondary windings W2 around the cores 23*a* and 23*c*. And, the electrode of a voltage to the primary winding W1 around the core 23*b* had a polarity opposite to that of the primary windings W1 around the cores 23*a* and 23*c*. Accordingly, the magnetic flux generated in the core 23*b* was directed opposite to the magnetic fluxes generated in the cores 23*a* and 23*c*. Referring to FIG. 4, the measurement of magnetic field was performed at positions (measurement points A) with respective distances d1 above from the middle part of the winding top surface in the vertical direction dY, and at positions (measurement points B) with respective distances d2 away from the middle part of the winding side surface in the horizontal direction dX orthogonal to the core length.

The measurement was performed on an inventive sample structured according to the present embodiment, and a comparative sample traditionally structured such that magnetic fluxes generated in the cores by currents flowing through the primary windings are directed identical with one another. The measurement results at the measurement points A are shown in FIG. 5, and the measurement results at the measurement points B are shown in FIG. 6. The magnetic filed due to leakage flux decreases with increase of the distances d (d1 and d2), more specifically, is inversely proportional approximately to the square of the distances d (d1 and d2). The measurement results show that the inventive sample has a smaller magnetic field than the comparative samples at both the measurement points A and B as shown in FIGS. 5 and 6, respectively, and substantially smaller especially at the measurement points A.

Specifically, for example, the inventive sample has magnetic fields of 6.9 A/m and 36 A/m respectively at the measurement point A with the distance d1 of 2 cm and the measurement point B with the distance d2 of 2 cm, while the comparative sample has magnetic fields of 91 A/m and 62 A/m, respectively. Thus, the present invention is effective in reducing the magnetic field attributable to leakage flux from the inverter transformer, especially effective with respect to the vertical direction dY above the top surface of the winding. The effect is rather small with respect to the horizontal direction dX orthogonal to the core length, because the magnetic fluxes which leak laterally from the cores 23*a* and 23*c* located at both sides spread in the air around.

Second and third embodiments of the present invention, which further enhance the effect achieved by the first embodiment, will be described with reference to FIGS. 7(*a*), 7(*b*) and 7(*c*), and FIGS. 7(*d*) and 7(*e*), respectively. In explaining the second and third embodiments in FIGS. 7(*a*) to 7(*e*), any component parts corresponding to those in FIG. 1 are denoted by the same reference numerals, and a detailed description thereof will be omitted below.

An inverter transformer 40 according to the second/third embodiment includes cores 23, bobbins 26, primary windings W1, secondary windings W2, primary winding terminal blocks 38*a*, and secondary winding terminal blocks 39*a*, and these components are partly (the second embodiment) or totally (the third embodiment) covered by a magnetic resin 6. The primary windings W1 are arranged around the cores 23 in the same way as the first embodiment, so that magnetic fluxes generated in the cores 23 by currents flowing through the primary windings W1 are directed opposite to each other on adjacent core basis.

Referring to FIGS. 7(*a*), 7(*b*) and 7(*c*) showing the second embodiment, a core 23*a*, a bobbin 26*a*, a primary winding 24*a*, a secondary winding 25*a*, and an insulation resin 50 to enclose the above-mentioned members constitute a first winding unit 51*a*; a core 23*b*, a bobbin 26*b*, a primary winding 24*b*, a secondary winding 25*b*, and an insulation resin 50 to enclose the above-mentioned members constitute a second winding unit 51*b*; and a core 23*c*, a bobbin 26*c*, a primary winding 24*c*, a secondary-winding 25*c*, and an insulation resin 50 to enclose the above-mentioned members constitute a third winding unit 51*c*. The first, second and third winding units 51*a*, 51*b* and 51*c* thus constituted make up a winding assembly 51. The winding assembly 51 is circumferentially covered by the aforementioned magnetic resin 6 except the bottom face as shown in FIG. 7(*b*) (this resin coverage structure refers to "a transformer body 55B" as described later), and with interspaces between the winding units 51*a*, 51*b* and 51*c* being filled up. The magnetic resin 6 may alternatively be arranged to cover the top face only of the circumference of them winding assembly, or the side faces or the bottom face only. The magnetic resin 6 covers the winding assembly 51 longitudinally from one ends of the cores 23*a*, 23*b* and 23*c* to the other ends thereof, and portions of the primary and secondary winding terminal blocks 38*a* and 39*a*.

Referring to FIGS. 7(*d*) and 7(*e*) showing the third embodiment, the winding assembly 51 is circumferentially covered by the magnetic resin 6 including the bottom face as shown in FIG. 7(*d*) (this resin coverage structure refers to "a transformer body 55A" as described later).

The magnetic resin 6 is formed of a mixture produced by mixing a magnetic substance of powder gained by pulverizing sintered Mn—Zn ferrite, and, for example, a thermosetting epoxy resin, where the Mn—Zn ferrite powder accounts for 80% in terms of volume ratio. In case of the inverter transformer 40, the mixture thus produced is applied to the winding assembly 51 (the first, second and third winding units 51*a*, 51*b* and 51*c* constituted respectively by the cores 23*a*, 23*b* and 23*c*, the bobbins 26*a*, 26*b* and 26*c*, the primary windings 24*a*, 24*b* and 24*c*, the secondary windings 25*a*, 25*b* and 25*c*, and the insulation resins 50) by molding, spreading, or the like, and is heated and cured by a temperature of, for example, 150 degrees C., whereby the mixture applied turns into the magnetic resin 6. The magnetic substance for the magnetic resin 6 is not limited to Mn—Zn ferrite, but may be Ni—Zn ferrite or ion powder, and the resin material may alternatively be nylon, and the like, which achieves a similar effect. The relative magnetic permeability of the magnetic resin 6 is determined so as to effectively shield against leakage flux coming out from the cores 23 and at the same time to duly constitute an open magnetic path structure. In the present embodiments, the relative magnetic permeability of the magnetic resin 6 can be controlled by changing the property of the magnetic substance, or changing the mixing ratio of the magnetic substance to the resin. For example, Mn—Zn ferrite or Ni—Zn ferrite achieves a relative magnetic permeability of several tens, and iron power achieves a relative magnetic permeability of several hundreds.

In the inverter transformer 40 shown in FIGS. 7(*a*), 7(*b*) and 7(*c*) according to the second embodiment, the magnetic resin 6 is arranged so as to cover the top and side faces only of the winding assembly 51 (including the first, second and third winding units 51*a*, 51*b* and 51*c*). In the inverter transformer 40 shown in FIGS. 7(*d*) and 7(*e*) according to the third embodiment, the magnetic resin 6 is arranged so as to cover the top, sides, and bottom faces, that is to say the entire circumferential faces, of the winding assembly 51, where the interspaces between the first, second and the third winding units 51*a*, 51*b* and 51*c* are filled up with the magnetic resin 6 in the same way as the second embodiment. In the transformers 40 according to the second and third embodiments, the magnetic resin 6 covers the winding assembly 51 longitudinally from the one ends of the cores 23*a*, 23*b* and 23*c* to the other ends thereof, and portions of the primary and secondary winding terminal blocks 38*a* and 39*a*, as described above. In this connection, all of the cores 23*a*, 23*b* and 23*c* (the winding assembly) are covered together by the magnetic resin 6 composed of one piece in the embodiments described above, but the present invention is not limited to this structure and the cores 23*a*, 23*b* and 23*c* (the first, second and third winding units 51*a*, 51*b* and 51*c*) may be covered individually by three separate pieces of magnetic resins.

The operation of the inverter transformers 40 according to the second and third embodiments will hereinafter be described.

Since the magnetic resin 6 has a significantly smaller relative magnetic permeability than the cores 23, all of magnetic fluxes generated at the cores 23 are not adapted to pass through the magnetic resin 6, but some parts of the magnetic fluxes are allowed to leak beyond the magnetic resin 6 due to the difference of their magnetic resistances, and thus leakage inductance is provided. That is to say, the magnetic path generated by the cores 23 and the magnetic resin 6 is not a closed magnetic path, and therefore the inverter transformer 40 substantially has an open magnetic path structure having leakage inductance. Accordingly, there are generated not only magnetic fluxes that pass entirely through the cores 23 so as to interlink the primary windings W1 and the secondary windings W2, but also leakage fluxes that interlink either with the primary windings W1 only or with the secondary windings W2 only thus failing to contribute to providing electromagnetic coupling between the primary windings W1 and the secondary windings W2, whereby leakage inductance is generated. The inverter transformer 40 operates in the same way as an inverter transformer structured with an open magnetic path and not covered by the magnetic resin 6, and the generated leakage inductance acts as ballast inductance so as to duly discharge and light the CCFLs connected to the secondary windings W2.

Unlike a traditional inverter transformer, in the inverter transformer 40 according to the second/third embodiment, the winding assembly 51 is surrounded by the magnetic resin 6 thereby causing the leakage inductance to act as ballast inductance, and at the same time most of the magnetic fluxes leaking from the cores 23 are adapted to pass through the magnetic resin 6 thus reducing the amount of magnetic fluxes leaking beyond the magnetic resin 6. Consequently, the range of leakage flux spreading out from the inverter transformer 40 is limited. Thus, the inverter transformer 40 is further effective in reducing leakage flux, because of the magnetic resin 6 reducing leakage flux as described above in combination with the leakage flux reducing effect achieved by the primary windings W1 arranged around the cores 23 in the same way as the first embodiment, especially in the direction dX as shown in FIG. 4.

The inverter transformer 40 shown in FIGS. 7(*a*), 7(*b*) and 7(*c*) according to the second embodiment, in which the bottom face of the winding assembly 51 is not covered by the magnetic resin 6, is desirable and suitable when mounted on a substrate or chassis made of a non-magnetic material. Specifically, when the inverter transformer 40 according to the second embodiment is mounted on a non-magnetic substrate or chassis, the magnetic paths of magnetic fluxes leaking from the cores 23 in the bottom direction are not influenced by anything thus reducing variation or change in the property. On the other hand, since the other faces than the bottom face, that is to say, the top and side faces, are covered by the magnetic resin 6, the range of leakage flux spreading out from the inverter transformer 40 is limited. Consequently, leakage inductance is duly achieved without having influence on neighboring components, and at the same time the height of the inverter transformer 40 can be reduced due to its bottom face not covered by the magnetic resin 6.

The inverter transformer 40 shown in FIGS. 7(*d*) and 7(*e*) according to the third embodiment, in which the top, side, and bottom faces of the winding assembly 51 are covered by the magnetic resin 6 longitudinally from one ends of the cores 23 to the other ends thereof, is desirable and suitable when mounted on a substrate or chassis made of a magnetic material. Specifically, since the bottom face of the inverter transformer 40 according to the third embodiment is also covered by the magnetic resin 6, magnetic fluxes leaking from the cores 23 are not subject to the influence of the magnetic substrate or chassis disposed under the bottom face due to the magnetic shielding function of the magnetic resin 6, and therefore the magnetic paths of the magnetic fluxes are not changed thus reducing variation in the property.

For optimizing the operation of an inverter transformer, the numbers of turns on primary and secondary windings and leakage inductance must be adjusted, but the characteristic of leakage inductance is caused to vary with a change in the magnetic property of the magnetic path of leakage flux. On the other hand, in the inverter transformer 40 of the present invention, leakage inductance is adjusted according to the optimal conditions for the circuit operation by adjusting the magnetic properties (such as relative permeability), thickness, and area range of the magnetic resin 6. As a result, the operation of the inverter transformer 40 can be flexibly optimized for application to various kinds of inverter transformers simply by adjusting the value of leakage inductance without changing the numbers of turns on the primary windings W1 and the secondary windings W2 and also the configuration and property of the cores 23.

In the inverter transformers 40 according to the second and third embodiments, the magnetic resin 6 is disposed so as to cover the bar-shaped cores 23 entirely from one end to the other, but insofar as leakage inductance is duly provided, the magnetic resin 6 does not necessarily have to entirely cover the cores 23 and may alternatively be disposed so as to partly cover the cores 23. Such a partial coverage structure is employed in fourth and fifth embodiments of the present invention described below.

The fourth and fifth embodiments mentioned above will be described with reference to FIGS. 8(*a*), 8(*b*) and 8(*c*). In explaining the examples shown in FIGS. 8(*a*), 8(*b*) and 8(*c*), any component parts corresponding to those in FIGS. 1 and 7(*a*) to 7(*e*) are denoted by the same reference numerals, and a detailed description thereof will be omitted below.

Figure 8A:
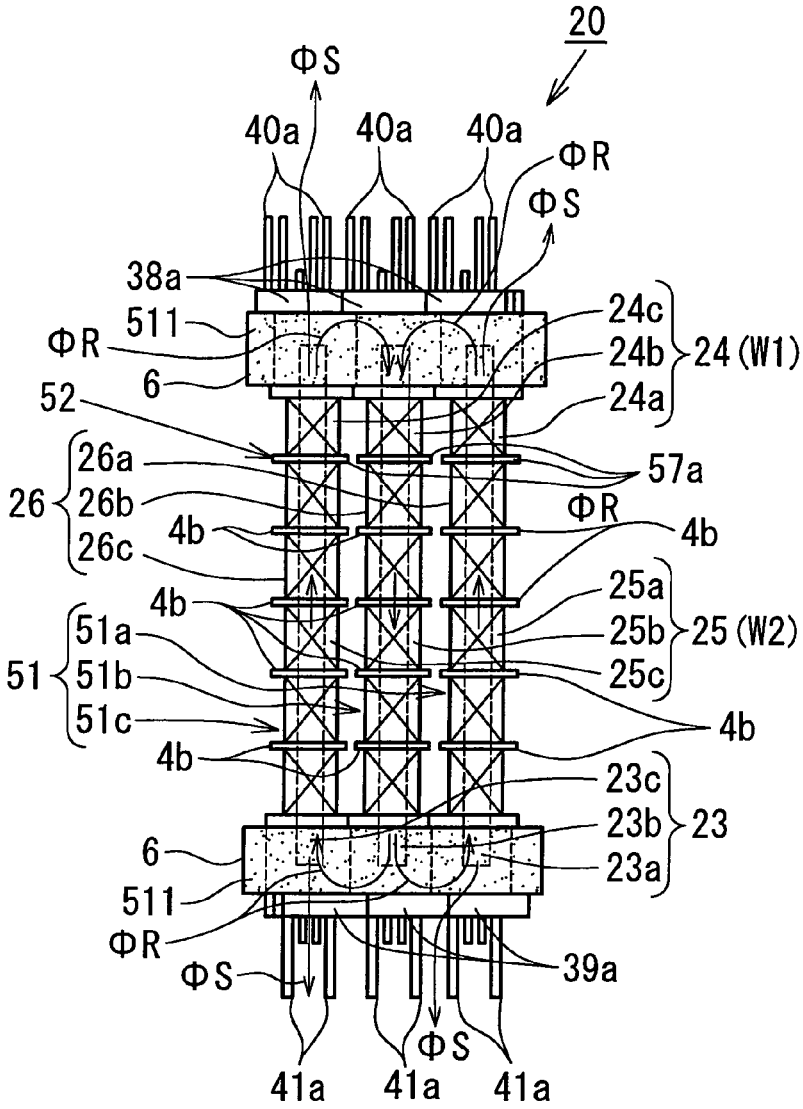
FIGS. 8(*a*) and 8(*b*) are respectively schematic top plan and front elevation views of an inverter transformer according to a fourth embodiment of the present invention, and FIG. 8(*c*) is a front elevation view of an inverter transformer according to a fifth embodiment of the present invention.
Figure 8B:
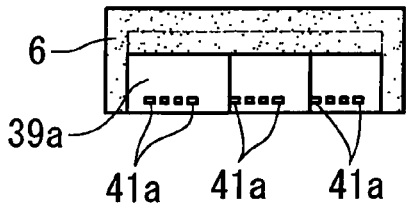
Figure 8C:
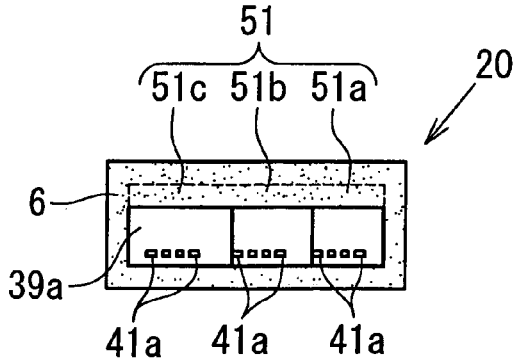

Referring to FIGS. 8(*a*), 8(*b*) and 8(*c*), in inverter transformers 20 according to the fourth and fifth embodiments, both end portions of cores 23 including portions of bobbins 26 and primary and secondary winding terminal blocks 38*a* and 39*a*, i.e. end portions 511 of a winding assembly 51 are individually covered by two separate magnetic resins 6, respectively, while the middle portions of the cores 23 are not covered thereby. In the inverter transformer 20 of the fourth embodiment, the two separate magnetic resins 6 are disposed so as to cover the top and side faces only of the end portions 511 as shown in FIG. 8(*b*), which is common to the second embodiment (refer to FIG. 7(*b*)), and which generates similar effects. On the other hand, in the inverter transformer 20 of the fifth embodiment, the two separate magnetic resins 6 are disposed so as to cover the top, side, and bottom faces of the end portions 511 as shown in FIG. 8(*c*), which is common to the third embodiment (refer to FIG. 7(*d*)), and effects similar to those in the third embodiment are achieved.

In the inverter transformers 20 according to the fourth and fifth embodiments, since both end portions of the cores 23 (the winding assembly 51) are covered totally or partly by respective magnetic resins 6, 6, most of leakage fluxes ΦR coming out from the end portion of the cores 23 are adapted to pass through the magnetic resins 6 functioning as a shield, and consequently the amounts of leakage fluxes ΦS spreading out in the open air around are reduced. Since the inverter transformers 20 according to the fourth and fifth embodiments are of an open magnetic path structure like the inverter transformer 40 according to the second and third embodiments, leakage inductance is generated at primary windings W1 and secondary windings W2 and functions as ballast inductance so as to duly light CCFLs.

In the fourth and fifth embodiments described above, the end portions of the cores 23 (23*a*, 23*b* and 23*c*) are covered together by the one piece magnetic resin 6, but the present invention is not limited to this structure and may alternatively be structured such that the end portions of the cores 23 are covered individually by three separate piece magnetic resins, respectively. In the inverter transformers 20 according to the fourth and fifth embodiments, leakage inductance is adjusted according to the optimal conditions for the circuit operation by adjusting the magnetic properties (such as relative permeability), thickness, and area range of the magnetic resin 6.

In the fourth and fifth embodiments, since the leakage fluxes ΦS coming from the end portions of the cores 23 and spreading out in the open air around are reduced as described above, components arranged close to the end portions of the cores 23*a* are kept magnetically uninfluenced, and at the same time, the inverter transformer 20 is prevented from getting influenced by magnetic fluxes coming from the components thus reducing variation and change in characteristics. Also, influences can be eliminated that may possibly arise when components including a magnetic substance are arranged close to the end portions of the cores 23.

Also, in the fourth and fifth embodiments, a partition portion 52 of the winding assembly 51 (composed of the first, second and third winding units 51*a*, 51*b* and 51*c*) provided with partitions 57*a* to separate the primary windings W1 from the secondary windings W2 may be covered by an additional magnetic resin. The partition portion 52 is an area where leakage flux is generated abundantly, and covering the partition portion 52 by a magnetic resin is very effective in further reducing the amount of magnetic flux exiting out from the inverter transformer 40 in the open space around. This measure of covering the partition portion 52 by a magnetic resin may be effectively implemented not only in the inverter transformer 20 according to the fourth or fifth embodiment but also in a traditional inverter transformer.

A sixth embodiment of the present invention will be described with reference to FIGS. 9(*a*), 9(*b*) and 9(*c*). In explaining the example shown in FIGS. 9(*a*), 9(*b*) and 9(*c*), any component parts corresponding to those in FIGS. 1, 7(*a*) to 7(*e*), and 8(*a*) to 8(*c*) are denoted by the same reference numerals, and a detailed description thereof will be omitted below.

Figure 9A:
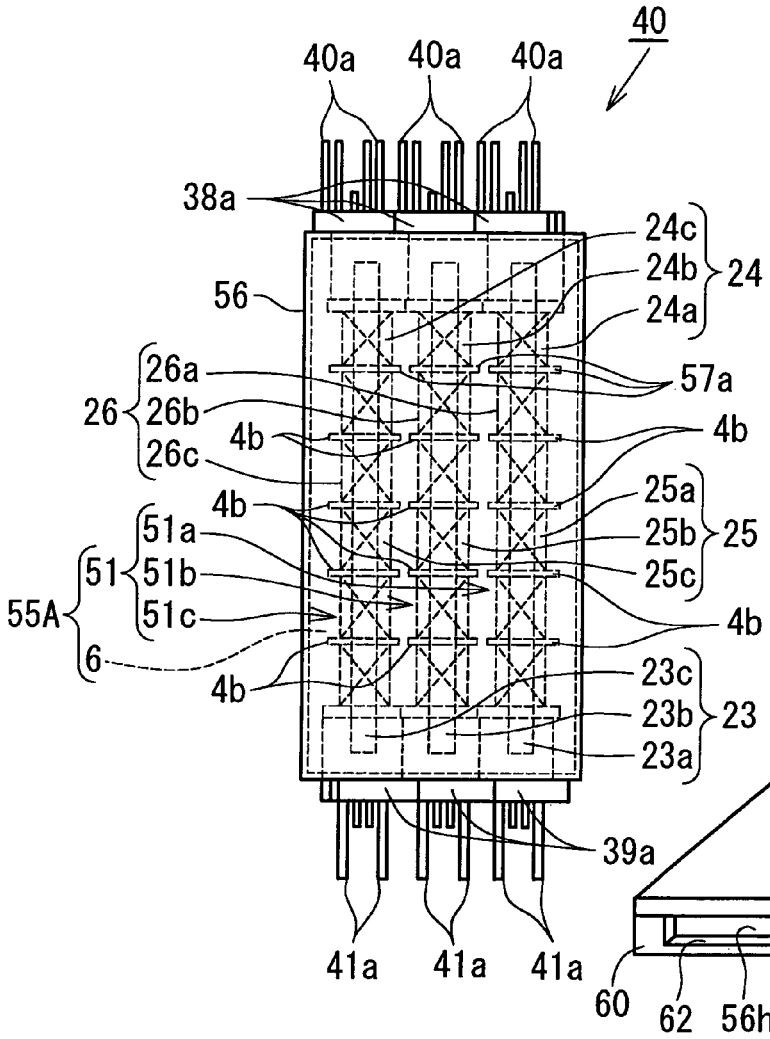
FIGS. 9(*a*) and 9(*c*) are respectively schematic top plan and front elevation views of an inverter transformer according to a sixth embodiment of the present invention, and FIG. 9(*b*) is a perspective view of an external unit used in the inverter transformer according to the sixth embodiment.
Figure 9B:
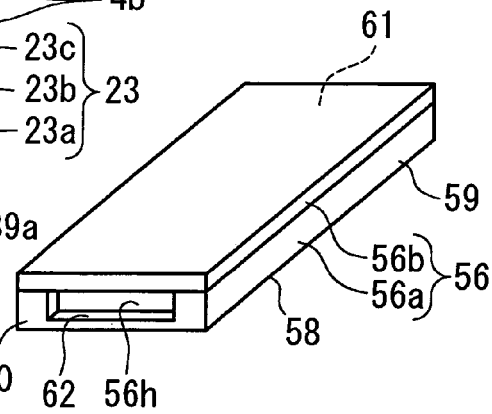
Figure 9C:
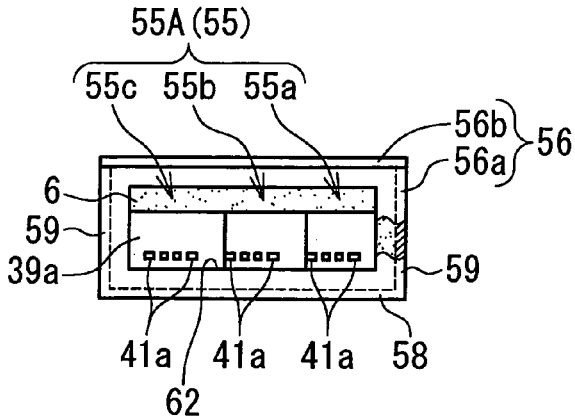

Referring to FIG. 9(*a*), in an inverter transformer 40 according to the sixth embodiment, a winding assembly 51 is entirely covered by a magnetic resin 6, including interspaces between first, second and third winding units 51*a*, 51*b* and 51*c*, in the same way as the third embodiment (refer to FIG. 7(*d*)), wherein the winding assembly 51 and the magnetic resin 6 constitute a transformer body 55. As mentioned previously, a transformer body 55, in which a winding assembly 51 is entirely covered, that is to say, has its top, side and bottom faces covered by a magnetic resin 6, is designated as "a transformer body 55A" (refer to FIG. 7(*d*)), while a transformer body 55, in which a winding assembly 51 has its top and side faces only covered by a magnetic resin 6, is designated as "a transformer body 55B" (refer to FIG. 7(*d*)).

Referring to FIGS. 9(*a*) to 9(*c*), in the inverter transformer 40 according to the sixth embodiment, the transformer body 55A is enclosed by an external unit 56 with primary and secondary winding terminal blocks 38*a* and 39*a* sticking out. The external unit 56 is composed of sintered compacts formed of, for example, Mn—Zn ferrite, or Ni—Zn ferrite, and has a larger saturation magnetic flux density and a smaller magnetic resistance than the magnetic resin 6. Referring to FIG. 9(*b*), the external unit 56 includes a first section 56*a* having a hollow 56*h* to receive the transformer body 55A, and a second section 56*b* disposed on the first section 56*a* so as to cover up the transformer body 55A.

Referring to FIGS. 9(*b*) and 9(*c*), the first section 56*a* includes a bottom 58, side walls 59 vertically disposed at the both sides of the bottom 58, a front end wall 60 vertically disposed at the front end (lower in FIG. 9(*a*)) of the bottom 58, and a rear end wall 61 (not seen in the figures) vertically disposed at the rear end (upper in FIG. 9(*a*)) of the bottom 58. A cutout 62 is formed at each of the front end wall 60 and the rear end wall 61, and some portions of the primary and secondary winding terminal blocks 38*a* and 39*a* protrude through respective cutouts 62. That is to say, the external unit 56 is adapted to enclose the transformer body 55A with the terminal blocks 7 and 8 sticking out.

In the inverter transformer 40 according to the sixth embodiment, since the external unit 56 (sintered compact) having a larger saturation magnetic flux density than the magnetic resin 6 is provided so as to enclose the transformer body 55A, most of magnetic fluxes leaking from the cores 23*a*, 23*b* and 23*c* so as to pass through the magnetic resin 6 and then to leak beyond the magnetic resin 6 are now adapted to pass through the external unit 56. Thus, with provision of the external unit 56, magnetic flux can be prevented from leaking out from the inverter transformer 40 more effectively than when the external unit 56 is not provided. Consequently, the cross section area of the structure according to the sixth embodiment can be reduced compared with the structure in which magnetic flux is prevented from leaking out by means of the magnetic resin 6 only, and the inverter transformer 40 can be downsized.

Since the external unit 56 has a smaller magnetic resistance than the magnetic resin 6, magnetic flux leaking out beyond the magnetic resin 6 passes through the external unit 56 more effectively. Consequently, magnetic flux can be further prevented from leaking out from the inverter transformer 40, which enables further downsizing of the inverter transformer 40.

The inverter transformer 40 according to the sixth embodiment is produced as follows. The winding assembly 51 is put in the hollow 56*h* of the first section 56*a* of the external unit 56 with the primary and secondary winding terminal blocks 38*a* and 39*a* fitted in the respective cutouts 62, and a resin material (the magnetic resin 6) is filled in the hollow 56*h* so as to mold the winding assembly 51. The magnetic resin 6 is heated at, for example, about 150 degrees C. for curing, and the transformer body 55A, which is composed of the winding assembly 51 and the magnetic resin 6 filled around the winding assembly 51, is obtained in the hollow 56*h*. Then, the second section 56*b* of the external unit 56 is put on the first section 56*a* so as to lid the hollow 56*h* having the transformer body 55A therein, thus the first section 56*a* and the second section 56*b*, in combination, enclose the transformer body 55A, and the inverter transformer 40 is obtained. Since the winding assembly 51 is molded by filling the magnetic resin 6 in the hollow 56*h*, the production is eased enhancing the productivity. In this connection, the second section 56*b* of the external unit 56 may be omitted so that the external unit 56 is constituted by the first section 56*a* only.

In the sixth embodiment, the external unit 56 is structured so as to cover the top, side, bottom, and front end and rear end (except the primary and secondary winding terminal blocks 38*a* and 39*a*) faces of the transformer body 55A, but the present invention is not limited to this structure and arrangement. For example, an inverter transformer may include a transformer body 55B in place of the transformer body 55A, and also may alternatively be structured in combination with any one of various external units as described below.

Figure 10A:
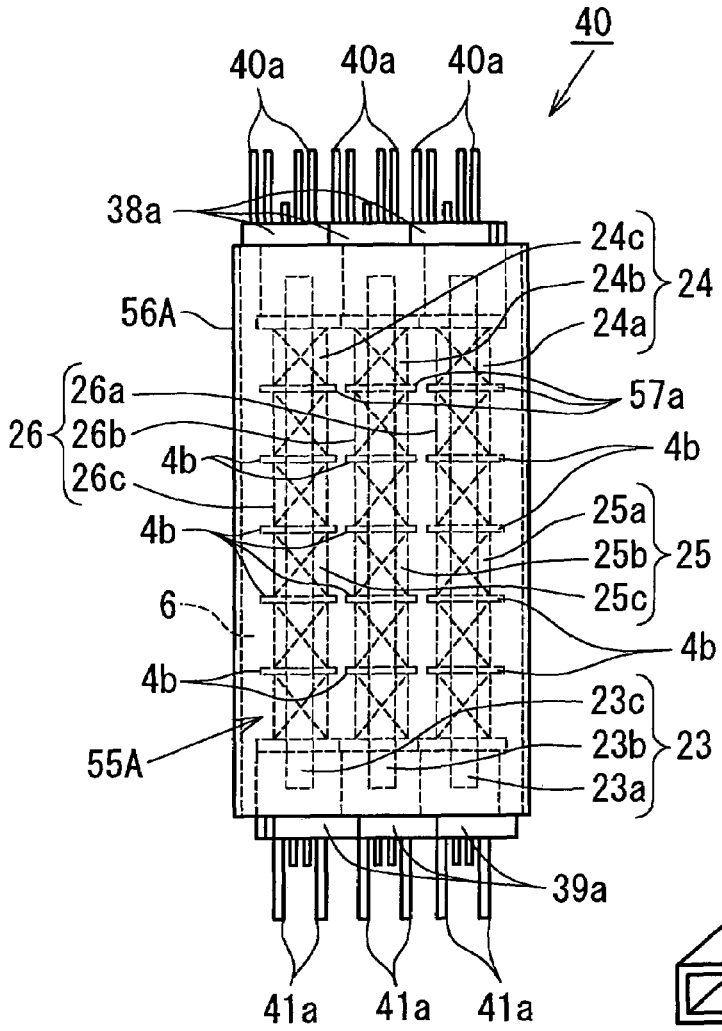
FIGS. 10(*a*) and 10(*c*) are respectively schematic top plan and front elevation views of an inverter transformer according to a seventh embodiment of the present invention, and FIG. 10(*b*) is a perspective view of an external unit used in the inverter transformer according to the seventh embodiment.
Figure 10B:
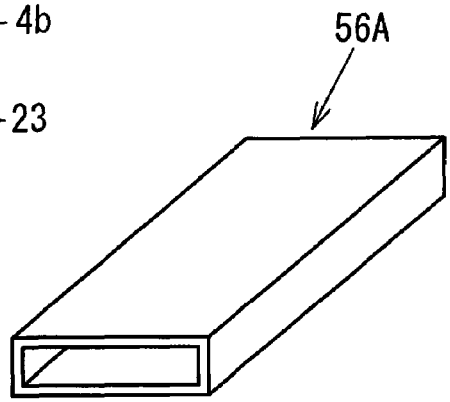
Figure 10C:
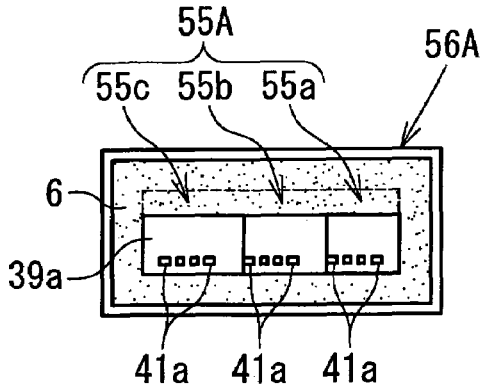
Figure 11A:
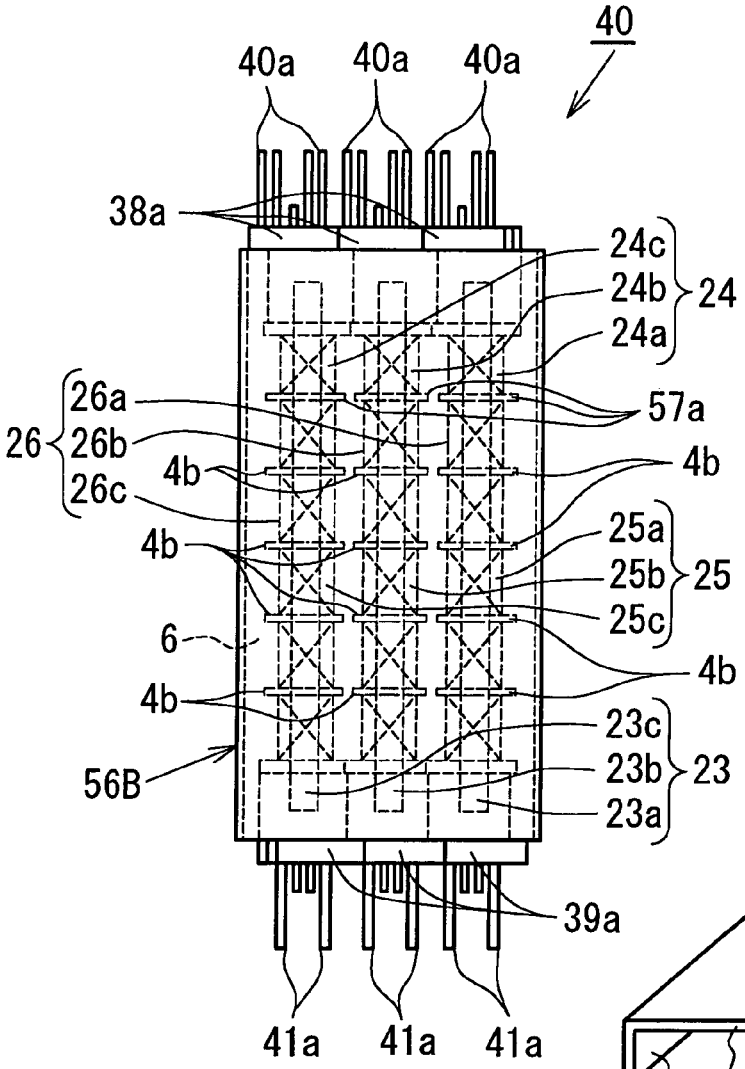
FIGS. 11(*a*) and 11(*b*) are respectively schematic top plan and front elevation views of an inverter transformer according to an eighth embodiment of the present invention, FIG. 11(*c*) is a perspective view of an external unit used in the inverter transformer according to the eighth embodiment, and FIG. 11(*d*) is a front elevation view of another inverter transformer according to the eleventh embodiment including a different type transformer body.
Figure 11C:
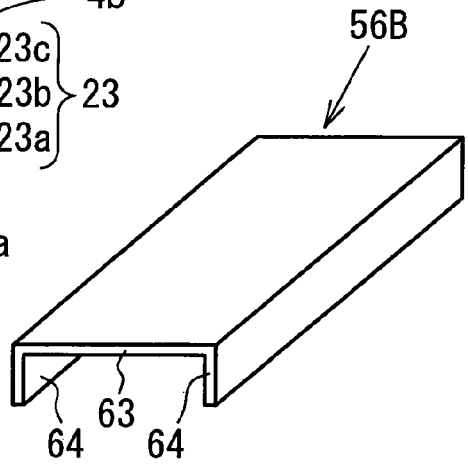
Figure 11B:
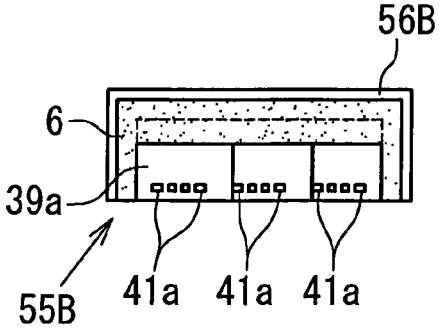
Figure 11D:
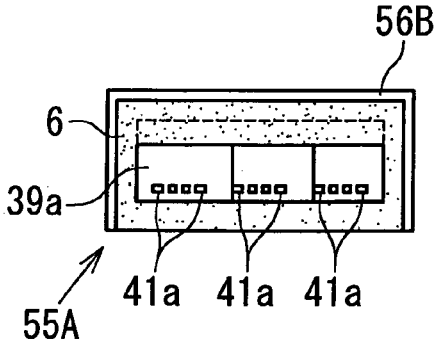
Figure 12A:
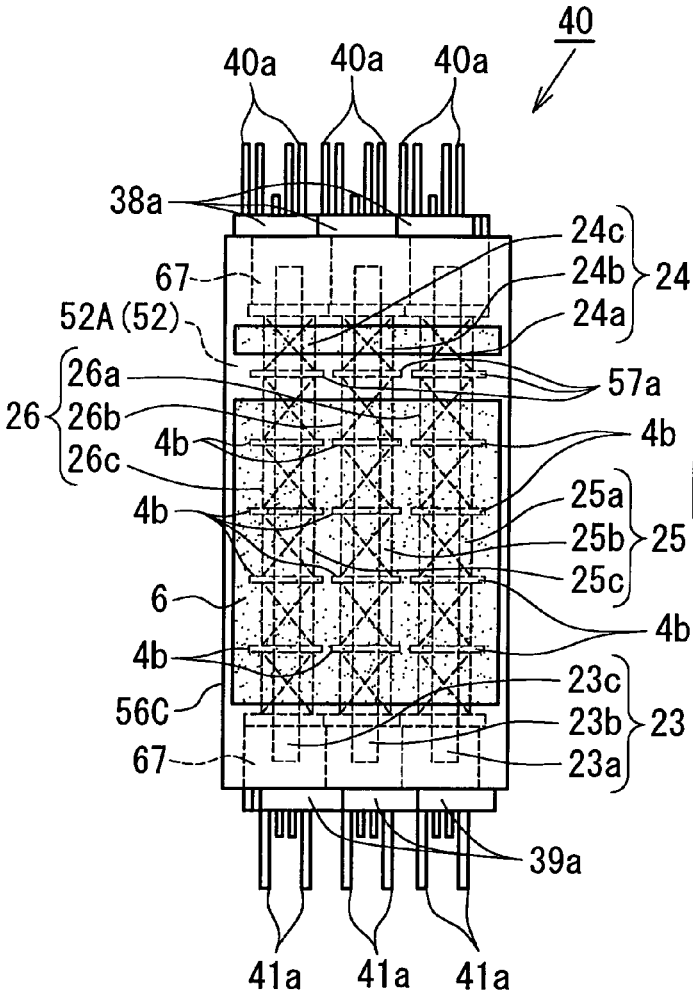
FIGS. 12(*a*) and 12(*b*) are respectively schematic top plan and front elevation views of an inverter transformer according to a ninth embodiment of the present invention, FIG. 12(*c*) is a perspective view of an external unit used in the inverter transformer according to the ninth embodiment, FIG. 12(*d*) is a front elevation view of another inverter transformer according to the ninth embodiment of the present invention, and FIG. 12(*e*) is s perspective view of an external unit used in an inverter transformer according to a tenth embodiment.
Figure 12C:
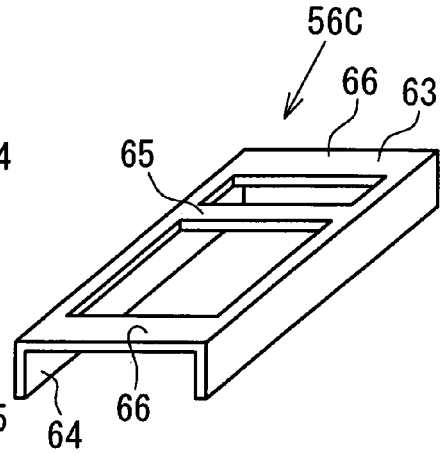
Figure 12E:
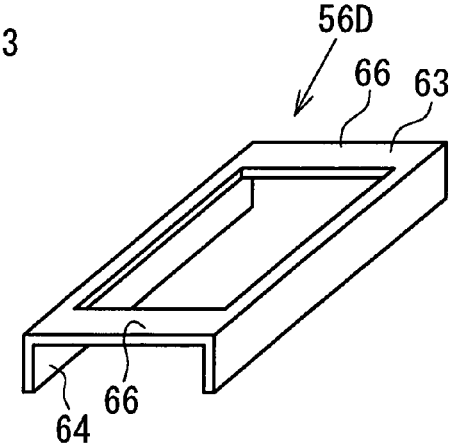
Figure 12B:
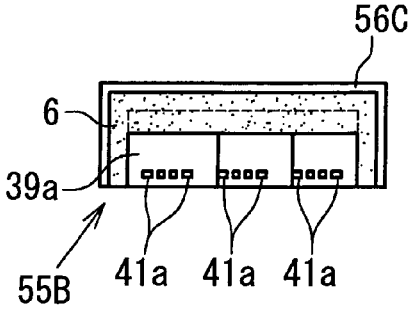
Figure 12D:
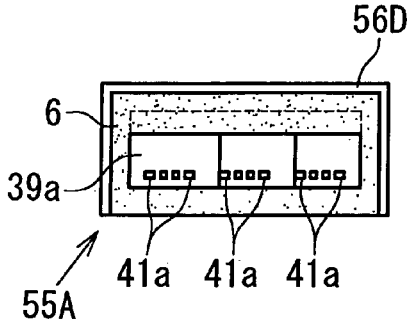
Figure 13A:
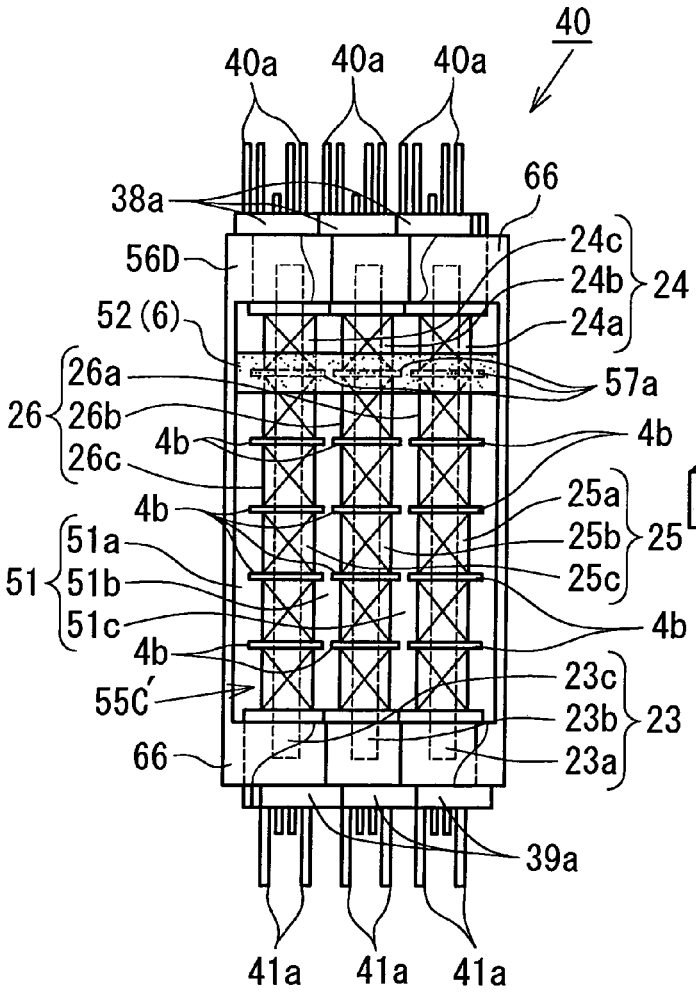
FIGS. 13(*a*) and 13(*b*) are respectively schematic top plan (partly sectioned) and cross-sectional views (taken along line A-A) of an inverter transformer according to an eleventh embodiment of the present invention, FIG. 13(*c*) is a cross-sectional view of an inverter transformer according to a twelfth embodiment of the present invention, and FIG. 13(*d*) is a perspective view of an external unit and a plate member used in an inverter transformer according to a thirteenth embodiment of the present invention.
Figure 13D:
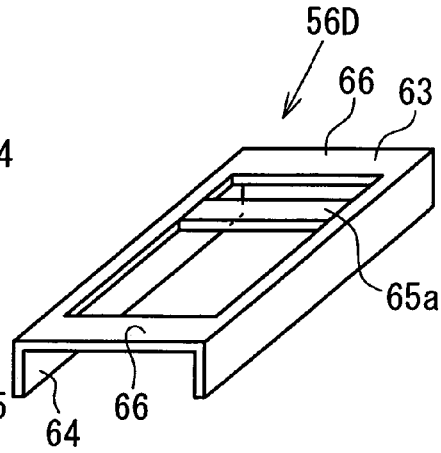
Figure 13B:
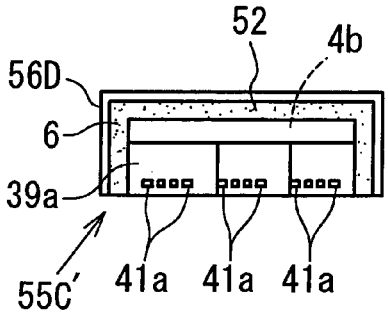
Figure 13C:
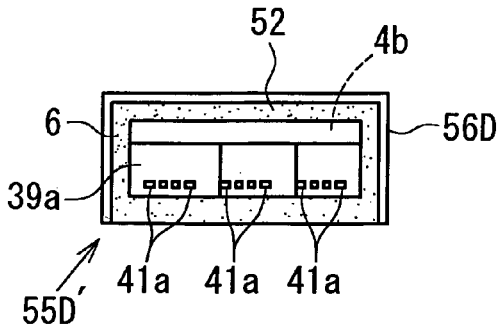

Referring to FIGS. 10(*a*), 10(*b*) and 10(*c*), an inverter transformer 40 according to a seventh embodiment includes an external unit 56A which is shaped into a rectangular tube so as to cover the top, side, and bottom faces of a transformer body 55A. The external unit 56A has a larger saturation magnetic flux density and a smaller magnetic resistance than a magnetic resin 6.

In the seventh embodiment, the external unit 56A does not cover the front end and rear end faces of the transformer body 55A but still covers most area of the outer surface thereof, and magnetic flux leaking out from the inverter transformer 40 can be duly reduced, and also the inverter transformer 40 can be downsized. And, since the external unit 56A has a smaller magnetic resistance than the magnetic resin 6, magnetic flux can be further prevented from leaking out from the inverter transformer 40, which enables further downsizing of the inverter transformer 40.

Referring to FIGS. 11(*a*), 11(*b*) and 11(*c*), an inverter transformer 40 according to an eighth embodiment includes an external unit 56B which is composed of a roof 63 and two side walls 64 vertically disposed at the both sides of the roof 63 so as to have a squared C shape in cross section, and which covers the top and side faces of a transformer body 55B. The external unit 56B has a larger saturation magnetic flux density and a smaller magnetic resistance than a magnetic resin 6.

In the eighth embodiment, the external unit 56B does not cover the bottom face of the transformer body 55B compared with the external unit 56A in the seventh embodiment described above but still covers a substantial area of the outer surface thereof, and magnetic flux leaking out from the inverter transformer 40 can be duly reduced, and also the inverter transformer 40 can be downsized. And, since the external unit 56B has a smaller magnetic resistance than the magnetic resin 6, magnetic flux can be further prevented from leaking out from the inverter transformer 40, which enables further downsizing of the inverter transformer 40.

In the eighth embodiment described above, the roof 63 of the external unit 56B is defined flat in accordance with the configuration of the transformer body 55B but may alternatively be, for example, arced when the transformer body 55B has an arced configuration. Also, a transformer body 55A may be used in the eighth embodiment in place of the transformer body 55B as shown in FIG. 11(*d*).

Referring to FIGS. 12(*a*), 12(*b*) and 12(*c*), an inverter transformer 40 according to a ninth embodiment includes an external unit 56C which is composed of a roof 63 and two side walls 64. The roof 63 is divided into a bridge portion 65 sandwiched between two openings and adapted to cover a partition portion 52A (including a partition portion 52 of a winding assembly 51) of a transformer body 55B provided with a partition 57*a*, two end frame portions 66 adapted to cover both end portions 67 of the transformer body 55B, and two side frame portions (not reference-numbered) perpendicularly adjacent to the side walls 64. The external unit 56C has a larger saturation magnetic flux density than a magnetic rein 6. In the ninth embodiment, a transfer body 55A may be used in place of the transformer body 55B as shown in FIG. 12(*d*).

Leakage flux is generated abundantly at the partition portion 52 of the winding assembly 51 as described above, but since the partition portion 52A including the partition portion 52 is covered by the bridge portion 65 of the external unit 56C and other portions thereof adjacent to the bridge portion 65, most of magnetic flux leaking out via the partition portion 52A is adapted to pass through the external unit 56C, and therefore leakage flux from the inverter transformer 40 can be well reduced. Also, since the end frame portions 66 of the roof 63 cover respective end portions 67 of the transformer body 55A, leakage flux from the inverter transformer 40 can be further reduced.

Referring to FIG. 12(*e*), in a tenth embodiment shown in, an external unit 56D is used, which differs from the external unit 56C of the ninth embodiment in that the bridge portion 65 is eliminated so as to form one opening in a roof 63.

Referring to FIGS. 13(*a*) and 13(*b*), in an inverter transformer 40 according to an eleventh embodiment, a transformer body 55C', in which a magnetic resin 6 covers the top and side faces of a partition portion 52 of a winding assembly 51, is used in combination with an external unit 56D (refer to FIG. 12(*e*)). Also, referring to FIG. 13(*c*), in a twelfth embodiment, a transformer body 55D', in which a magnetic resin 6 covers the top, side and bottom faces of a partition portion 52 of a winding assembly 51, is used.

Referring to FIG. 13(*d*), in a thirteenth embodiment, a plate member 65*a* is separately attached after an external unit 56D as shown in FIG. 12(*e*) is attached to a winding assembly 51. The plate member 65*a* is formed of a material equivalent to that of the external unit 56D or a magnetic resin 6.

Figure 14A:
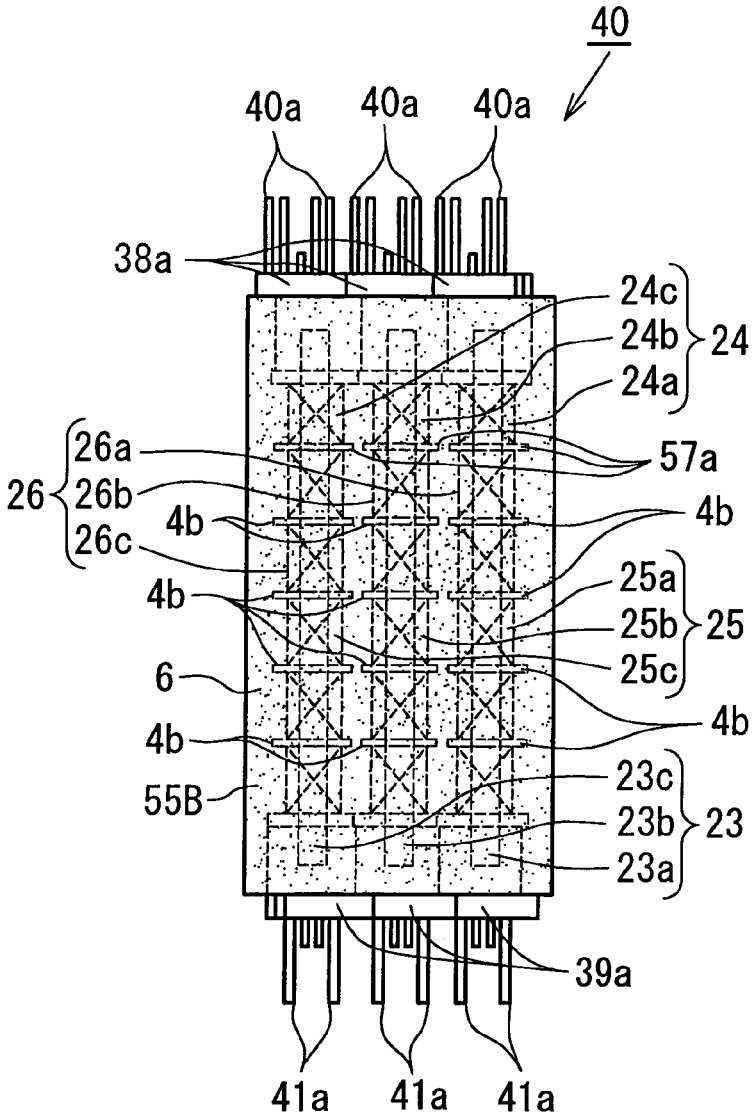
FIGS. 14(*a*) and 14(*b*) are respectively schematic top plan and front elevation views of an inverter transformer according to a fourteenth embodiment of the present invention.
Figure 14B:
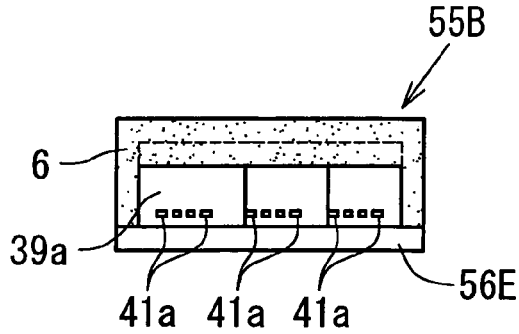

Referring to FIGS. 14(*a*) and 14(*b*), an inverter transformer 40 according to a fourteenth embodiment includes an external unit 56E which is composed of a plate having a rectangular configuration in plan view. The external unit 56E is disposed under a transformer body 55B so as to cover the bottom face of the transformer body 55B. The external unit 56E has a larger saturation magnetic flux density than a magnetic resin 6. In the fourteenth embodiment, a transformer body 55A may be used in place of the transformer body 55B.

Figure 15A:
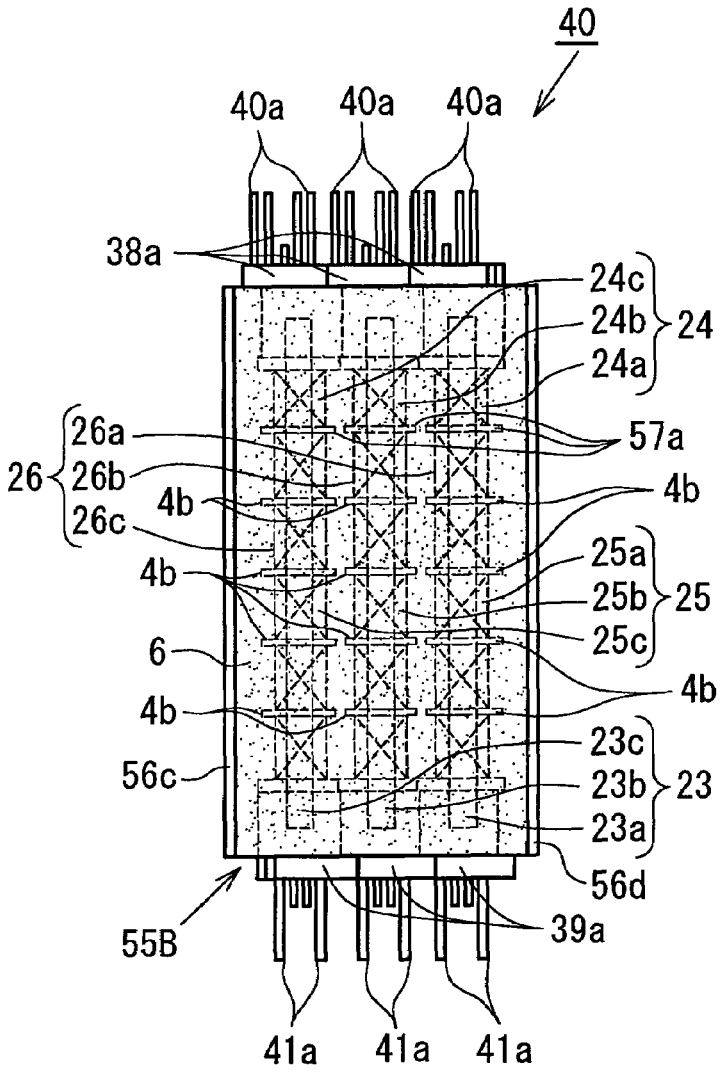
FIGS. 15(*a*) and 15(*b*) are respectively schematic top plan and front elevation views of an inverter transformer according to a fifteenth embodiment of the present invention, and FIG. 15(*c*) is a front elevation view of another inverter transformer according to the fifteenth embodiment of the present invention.
Figure 15B:
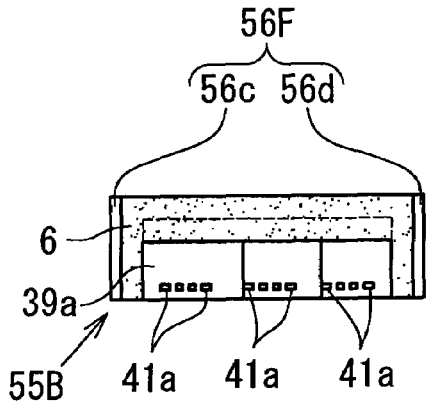
Figure 15C:
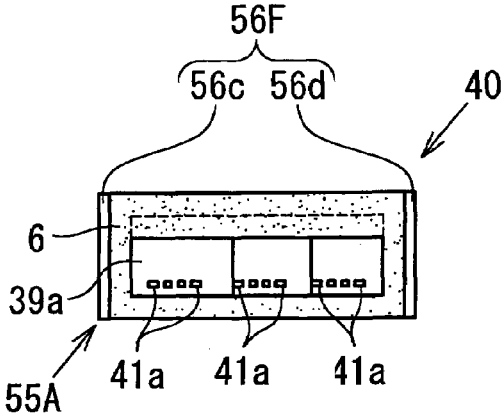

Referring to FIGS. 15(*a*) and 15(*b*), an inverter transformer 40 according to a fifteenth embodiment includes an external unit 56F which is composed of first and second rectangular plates 56*c* and 56*d*. The first and second plates 56*c* and 56*d* are disposed respectively at both sides of a transformer body 55B so as to cover the side faces of the transformer body 55B. The external unit 56F has a larger saturation magnetic flux density than a magnetic resin 6. In the fifteenth embodiment, a transformer body 55A may be used in place of the transformer 55B as shown in FIG. 15(*c*).

Figure 16A:
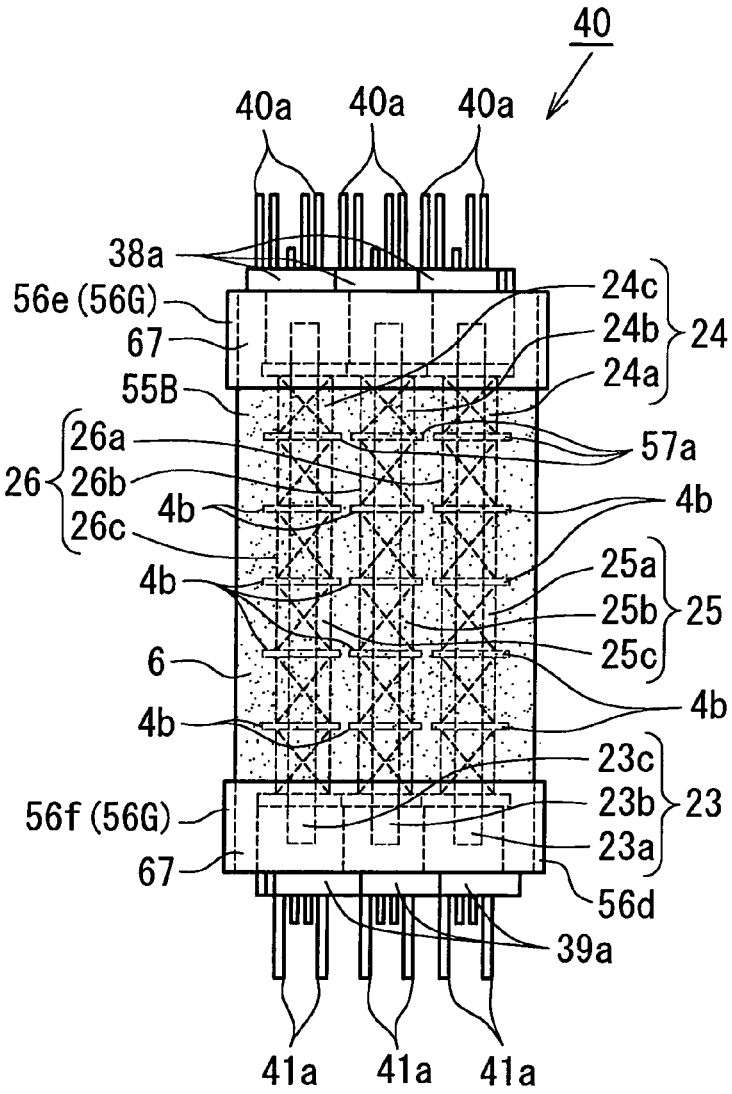
FIGS. 16(*a*) and 16(*b*) are respectively schematic top plan and front elevation views of an inverter transformer according to a sixteenth embodiment of the present invention, and FIG. 16(*c*) is a front elevation view of an inverter transformer according to a seventeenth embodiment of the present invention.
Figure 16B:
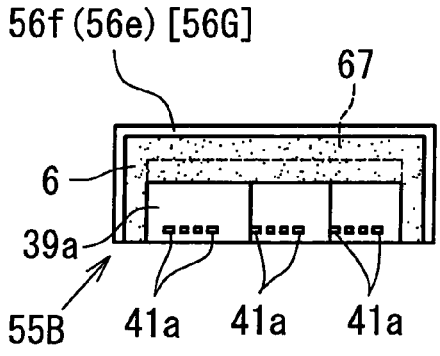
Figure 16C:
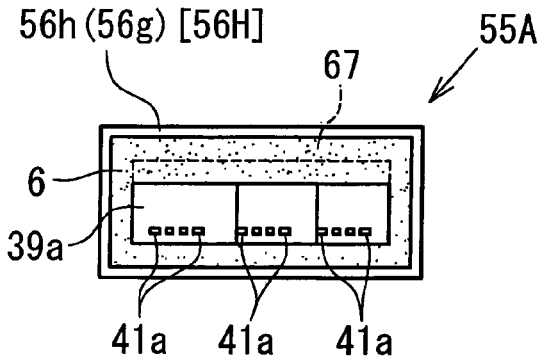
Figure 17A:
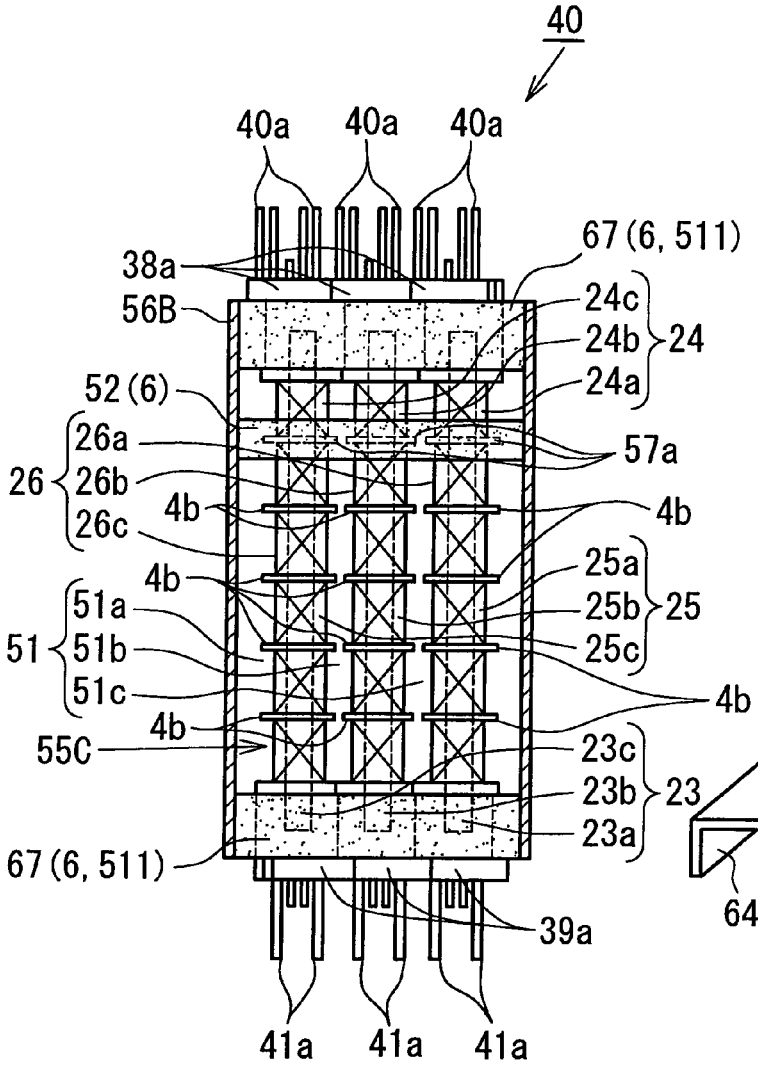
FIGS. 17(*a*) and 17(*c*) are respectively schematic top plan and front elevation views of an inverter transformer according to an eighteenth embodiment of the present invention, FIG. 17(*b*) is a perspective view of an external unit used in the inverter transformer according to the eighteenth embodiment, and FIG. 17(*d*) is a front elevation view of an inverter transformer according to a nineteenth embodiment of the present embodiment.
Figure 17B:
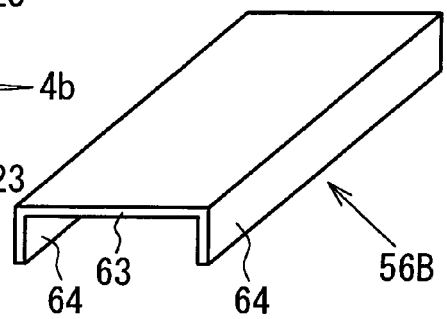
Figure 17C:
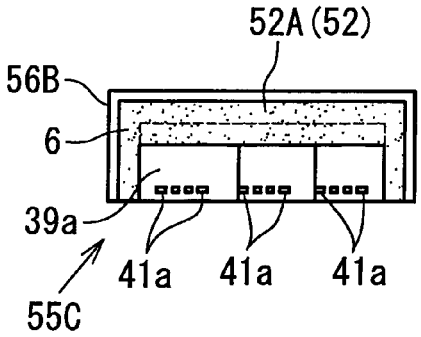
Figure 17D:
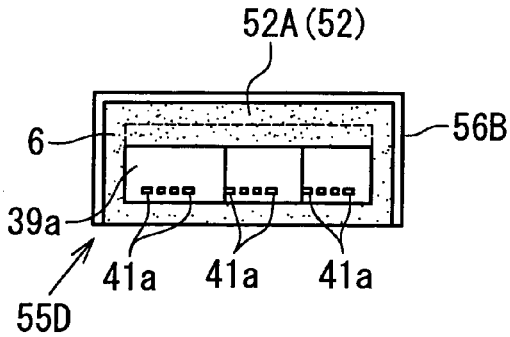

Referring to FIGS. 16(*a*) and 16(*b*), an inverter transformer 40 according to a sixteenth embodiment includes an external unit 56G which is composed of first and second members 56*e* and 56*f* each formed in a structure having a squared C shape in cross section. The first and second members 56*e* and 56*f* are disposed respectively at both end portions 67 of a transformer body 55B so as to cover the top and side faces of respective end portions 67. The external unit 56G has a larger saturation magnetic flux density than a magnetic resin 6. In the sixteenth embodiment, a transformer body 55A may be used in place of the transformer body 55B.

Referring to FIG. 16(*c*), an external unit 56H in a seventeenth embodiment is composed of first and second members 56*g* and 56*h* each formed in a structure constituting a rectangular frame configuration in cross section. The first and second members 56*g* and 56*h* are disposed respectively at both end portions 67 of a transformer body 55A so as to cover the top, side, and bottom faces of respective end portions 67. The external unit 56H has a larger saturation magnetic flux density than a magnetic resin 6. In the seventeenth embodiment, a transformer body 55B may be used in place of the transformer body 55A.

In the second to tenth embodiments shown in FIGS. 7(*a*) through 12(*e*), and in the fourteenth to seventeenth embodiments shown in FIGS. 14(*a*) through 16(*c*), an inverter transformer includes either a transformer body 55A (where a magnetic resin 6 covers all circumferential faces of a winding assembly 51) or a transformer body 55B (where a magnetic resin 6 covers the top and side faces only of a winding assembly 51). Also, in the eleventh to thirteenth embodiments shown in FIGS. 13(*a*) to 13(*d*), an inverter transformer includes either a transformer body 55C' or a transformer body 55D'. The present invention, however, is not limited to this transformer body arrangement and any different type transformer bodies may be used in combination with an external unit 56 or any one of its modification.

For example, referring to FIGS. 17(*a*), 17(*b*) and 17(*c*), a transformer body 55C, in which a magnetic resin 6 is composed of three pieces adapted to cover respectively both end portions 511, 511 and a partition portion 52 of a winding assembly 51 at the top and side faces thereof, is used in combination with an external unit 56B (an eighteenth embodiment). Also, referring to FIG. 17(*d*), a transformer body 55D, in which a magnetic resin 6 is composed of three pieces adapted to cover respectively both end portions 511, 511 and a partition portion 52 of a winding assembly 51 at the top, side and bottom faces, is used in combination with an external unit 56B (a nineteenth embodiment).

Figure 18A:
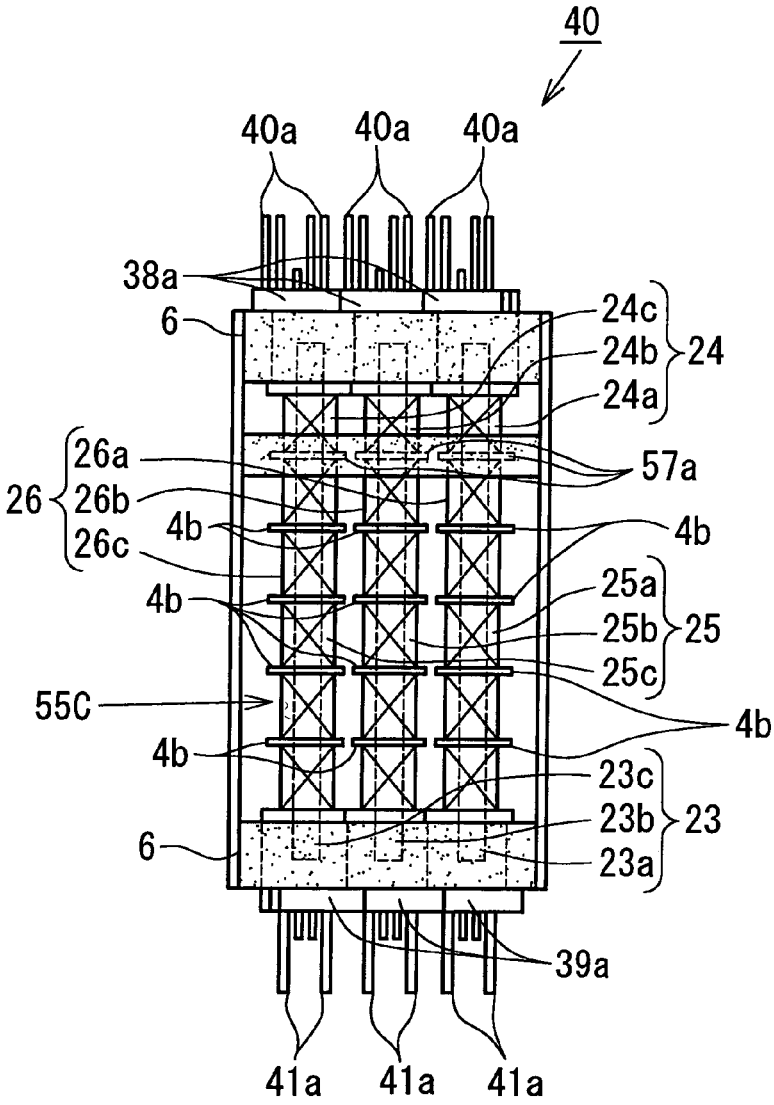
FIGS. 18(*a*) and 18(*b*) are respectively schematic top plan and front elevation views of an inverter transformer according to a twentieth embodiment of the present invention, and FIG. 18(*c*) is a front elevation view of an inverter transformer according to a twenty first embodiment of the present invention.
Figure 18B:
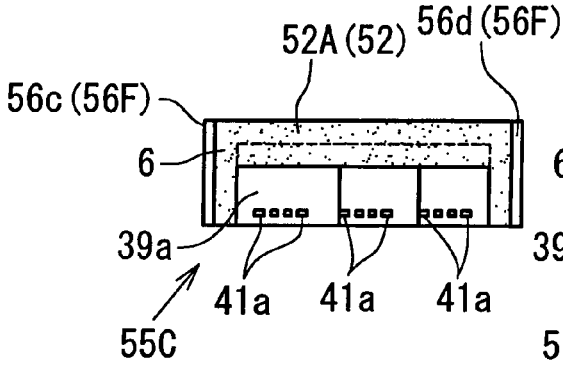
Figure 18C:
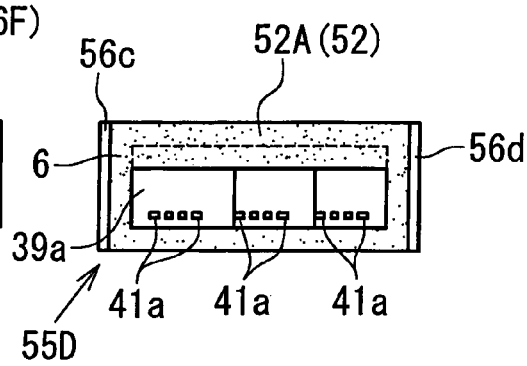
Figure 19:
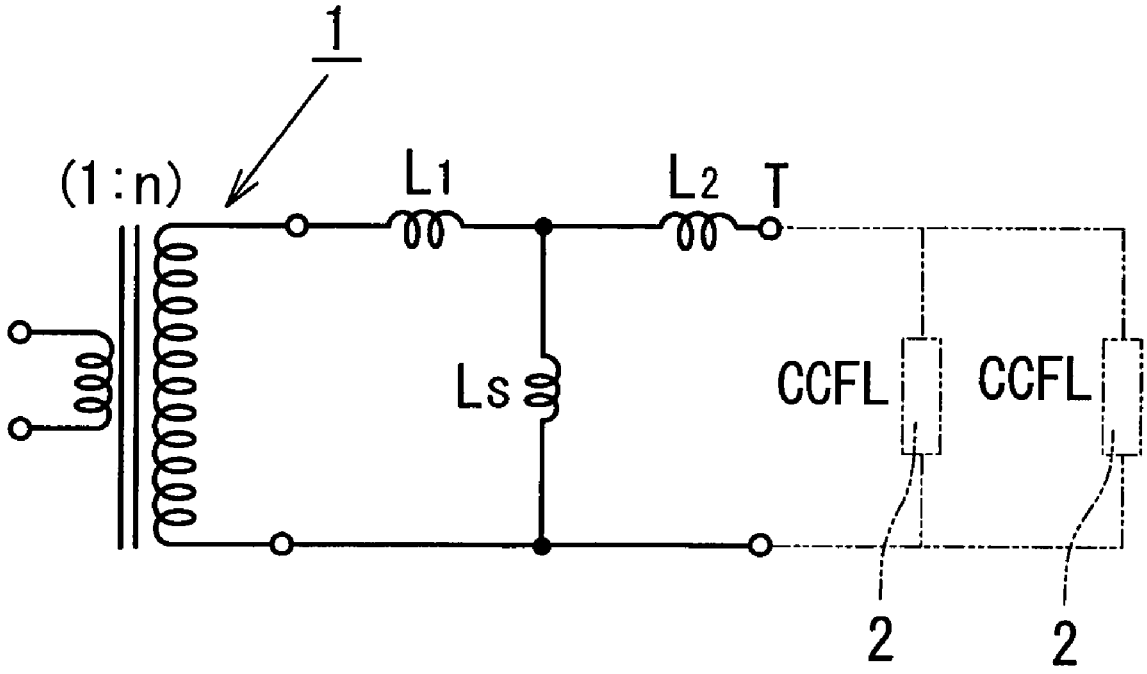
FIG. 19 is an equivalent circuit of an inverter transformer having a leakage inductance.
Figure 20:
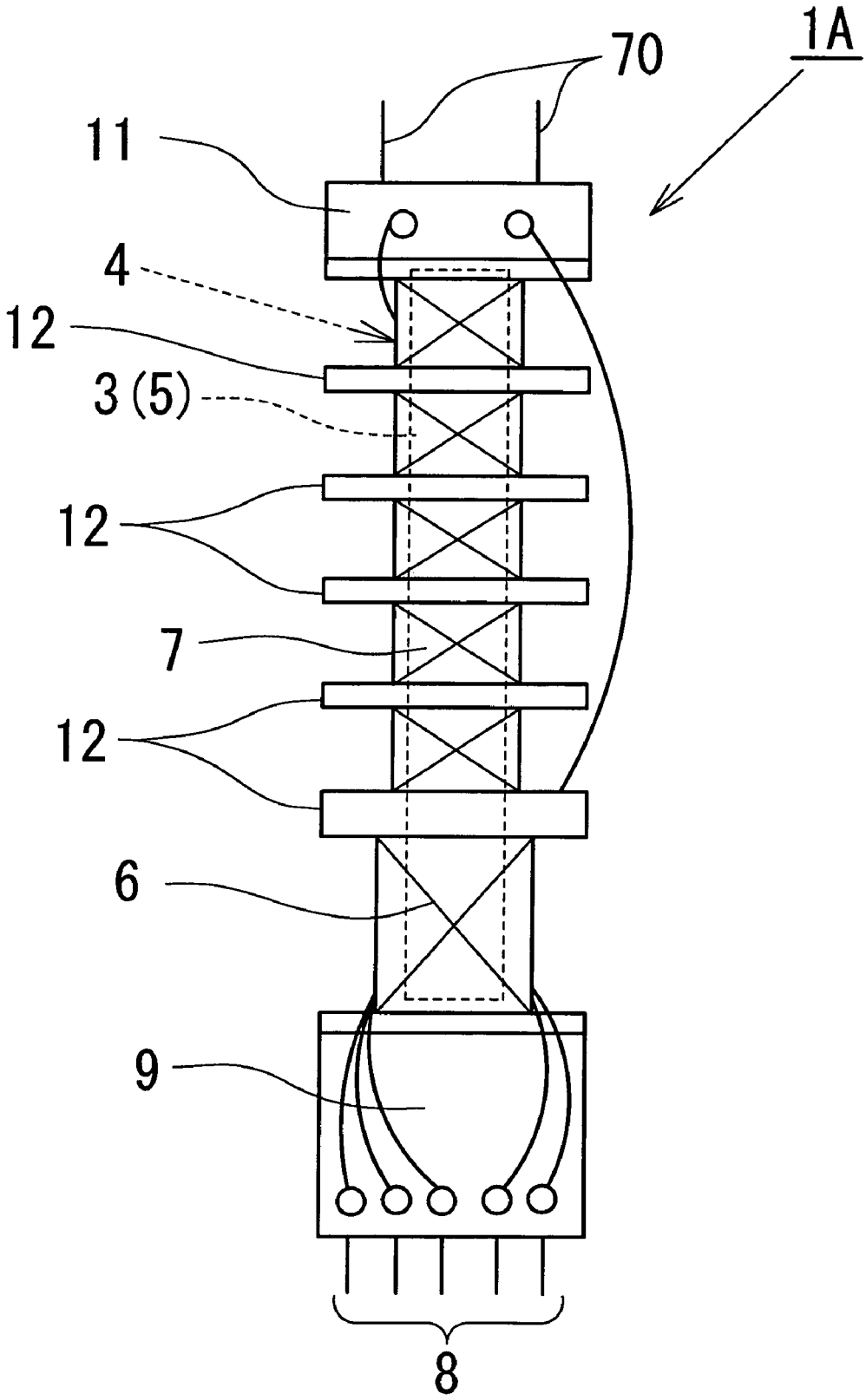
FIG. 20 is a schematic top plan view of a traditional inverter transformer including a bar-shaped magnetic core.
Figure 21:
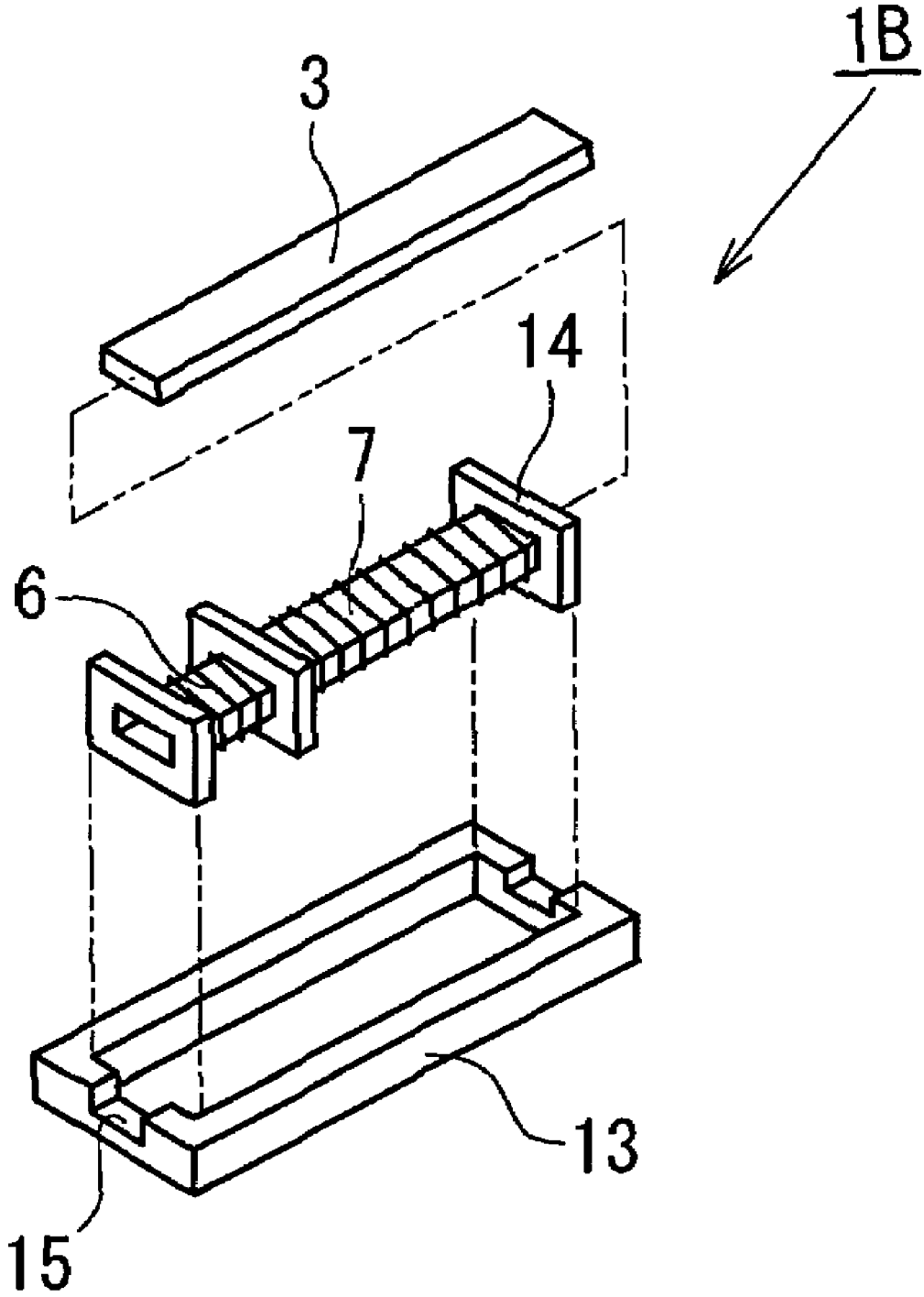
FIG. 21 is an exploded perspective view of another traditional inverter transformer including a bar-shaped magnetic core.

And, referring to FIGS. 18(*a*) and 18(*b*), an external unit 56F composed of first and second rectangular plates 56*c* and 56*d* is used in combination with a transformer body 55C (a twentieth embodiment). Also, referring to FIG. 18(*c*), an external unit 56F composed of first and second rectangular plates 56*c* and 56*d* is used in combination with a transformer body 55D (a twenty first embodiment).

INDUSTRIAL APPLICABILITY

An inverter transformer with an open magnetic path structure can be provided, whose entire structure and production process are simplified thus preventing cost increase.

The invention claimed is:

1. An inverter transformer which is provided in an inverter circuit to invert DC into AC, and which transforms a voltage inputted at a primary side and outputs the transformed voltage at a secondary side, the inverter transformer comprising a plurality of winding units, each comprising: a bar-shaped magnetic core; and a primary winding and a secondary winding which are wound around the bar-shaped magnetic core, and which have respective leakage inductances, wherein the primary windings are wound around respective magnetic cores in such a manner that a magnetic flux generated in one magnetic core by a current flowing through a primary winding provided around the one magnetic core is directed opposite to a magnetic flux generated in another magnetic core adjacent to the one magnetic core by a current flowing through a primary winding provided around the adjacent magnetic core.

2. An inverter transformer according to claim 1, wherein at least one portion of each winding unit is covered with respect to a longitudinal direction by a magnetic resin formed of a resin containing a magnetic substance.

3. An inverter transformer according to claim 2, wherein the magnetic resin covers an entire portion of each winding unit.

4. An inverter transformer according to claim 2, wherein the magnetic resin covers at least one of: both end portions of each winding unit; and a portion of each winding unit located at a boundary area between the primary and secondary windings.

5. An inverter transformer according to claim 1, wherein an external unit having a larger saturation magnetic flux density than the magnetic resin is disposed so as to cover at least one portion of a circumference of a transformer body which comprises the plurality of winding units and the magnetic resin.

6. An inverter transformer according to claim 5, wherein the external unit has a smaller magnetic resistance than the magnetic resin.

7. An inverter transformer according to claim 5, wherein the external unit has one of a squared C configuration and a substantially circular configuration in cross section so as to cover the circumference of the transformer body.

8. An inverter transformer according to claim 5, wherein the external unit comprises a plurality of members, and the members are combined into a box configuration so as to cover the transformer body.

9. An inverter transformer according to claim 5, wherein the external unit is a sintered compact.

10. An inverter transformer according to claim 1, wherein the magnetic resin has a smaller relative magnetic permeability than the bar-shaped magnetic cores.

11. An inverter transformer according to claim 2, wherein the magnetic substance contained in the resin is one of Mn—Zn ferrite, Ni—Zn ferrite, and iron powder.

* * * * *